US010873142B2

(12) United States Patent
Goh et al.

(10) Patent No.: US 10,873,142 B2
(45) Date of Patent: Dec. 22, 2020

(54) INTERMEDIATE ADAPTER CONNECTOR AND CONNECTOR ASSEMBLY

(71) Applicant: Molex, LLC, Lisle, IL (US)

(72) Inventors: Hoon-Chan Goh, Singapore (SG); Chie-Meng Wong, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/507,525

(22) Filed: Jul. 10, 2019

(65) Prior Publication Data

US 2020/0153133 A1 May 14, 2020

(30) Foreign Application Priority Data

Jul. 10, 2018 (CN) ..... 2018 1 0750673

(51) Int. Cl.
*H01R 12/70* (2011.01)
*H01R 12/72* (2011.01)
*H01R 13/6587* (2011.01)

(52) U.S. Cl.
CPC ..... *H01R 12/7082* (2013.01); *H01R 12/727* (2013.01); *H01R 13/6587* (2013.01)

(58) Field of Classification Search
CPC ..... H01R 12/7082; H01R 12/727; H01R 13/6587
See application file for complete search history.

(56) References Cited

U.S. PATENT DOCUMENTS 5,554,038 A * 9/1996 Morlion ..... H01R 13/514 439/108
5,664,968 A * 9/1997 Mickievicz ..... H01R 13/6587 439/607.1
5,702,258 A 12/1997 Provencher et al.
5,908,322 A * 6/1999 Seki ..... H01R 9/2458 439/212

(Continued)

FOREIGN PATENT DOCUMENTS

CN 103477503 A 12/2013
CN 104078799 A 10/2014

(Continued)

OTHER PUBLICATIONS

Office action and search report received for CN application No. 201810750673.7 dated Aug. 31, 2020, 23 pages. (13 pages of english translation and 10 pages of official copy).

*Primary Examiner* — Truc T Nguyen

(57) ABSTRACT

The present disclosure discloses an intermediate adapter connector and an electrical connector assembly, which are adapted to electrically connect a first connector and a second connector. The intermediate adapter connector comprises a plurality of insulating spacers and a plurality of terminal modules, the plurality of terminal module and the plurality of insulating spacer are alternately arranged and stacked in a first direction, so that each terminal module is positioned between two adjacent insulating spacers, and each terminal module comprises a terminal plate and a shield plate which are stacked in a front-rear direction, the terminal plate has a (Continued)

plurality of conductive terminals arranged in a second direction, each conductive terminal has a first contact portion and a second contact portion positioned at two opposite sides in a third direction.

20 Claims, 25 Drawing Sheets

(56) References Cited

U.S. PATENT DOCUMENTS 6,238,232 B1 * 5/2001 Briggs, Jr. ..... H01R 9/24 439/404
6,394,822 B1 * 5/2002 McNamara ..... H01R 13/6585 439/108
6,814,620 B1 * 11/2004 Wu ..... H01R 13/514 439/225
7,001,187 B2 * 2/2006 Terunuma ..... H01R 9/226 439/76.2
7,798,852 B2 9/2010 Laurx et al.
7,967,638 B1 * 6/2011 Kline ..... H01R 12/7082 439/607.07
8,662,924 B2 * 3/2014 Davis ..... H01R 13/6477 439/607.07
8,894,442 B2 * 11/2014 McClellan ..... H01R 13/6587 439/607.05
8,905,786 B2 * 12/2014 Davis ..... H01R 13/6587 439/607.1
8,992,252 B2 * 3/2015 McClellan ..... H01R 13/6587 439/607.05
8,992,253 B2 * 3/2015 McClellan ..... H01R 12/71 439/607.05
9,455,533 B1 * 9/2016 Evans ..... H01R 13/6587
10,367,280 B2 * 7/2019 Lloyd ..... H01R 24/22
2002/0086582 A1 * 7/2002 Nitta ..... H01R 13/6585 439/607.05
2002/0187688 A1 * 12/2002 Marvin ..... H01R 4/024 439/862
2007/0010112 A1 * 1/2007 Makino ..... H01R 9/226 439/76.2
2009/0264001 A1 * 10/2009 Yi ..... H01R 13/514 439/248
2009/0264023 A1 * 10/2009 Yi ..... H01R 13/514 439/709
2014/0004746 A1 * 1/2014 Cartier, Jr. ..... H01R 43/20 439/626
2014/0248796 A1 * 9/2014 Pan ..... H01R 12/00 439/540.1
2014/0342607 A1 * 11/2014 Wang ..... H01R 13/518 439/607.05
2016/0365661 A1 * 12/2016 Annis ..... H01R 12/62
2017/0025783 A1 * 1/2017 Astbury ..... H01R 13/6474

FOREIGN PATENT DOCUMENTS

CN 102142641 B 4/2015
EP 0492944 A2 7/1992
EP 0561202 A1 9/1993
TW 435757 U 8/2012

* cited by examiner

INTERMEDIATE ADAPTER CONNECTOR AND CONNECTOR ASSEMBLY

RELATED APPLICATIONS CLAIMING PRIORITY

This application claims priority to Chinese application No. 201810750673.7, filed on Jul. 10, 2018, which application is incorporated herein by reference in its entirety.

FIELD OF THE PRESENT DISCLOSURE

The present disclosure relates to an electrical connector, and particularly relates to an intermediate adapter connector and an electrical connector assembly.

BACKGROUND OF THE PRESENT DISCLOSURE

U.S. Pat. No. 5,702,258 discloses a connector illustrating a plurality of shield members, each shield member electrically connects at least two points to a selected contact assembly. U.S. Pat. No. 7,798,852 discloses a connector in which FIG. 23D illustrates that two terminal columns are arranged such that the wide ground shield terminal faces a pair of narrow signal terminals. The terminal pattern is maintained in a straight line. Each pair of signal terminals has a ground terminal on a side of the signal terminals pair and at least one ground terminal faces the signal terminal pair. The shield arrangement between the ground terminals and the signal terminal pairs is only between the body portions of the terminals, but is not between the contact portions of the terminals, moreover, the connector of this patent is configured to mount on a circuit board. U.S. Pat. No. 7,967,638 (corresponding to Chinese Patent application publication No. CN102201622A) discloses a connector configured to directly connect two circuit boards, each insulating housing of the connector comprises a plurality of tabs, and organizers define a plurality of openings respectively accommodating the plurality of tabs.

The above connector is provided on the circuit board or directly connects the two circuit boards, however, if the above connector acts as an intermediate adapter connector that connects the two connectors, for example the intermediate adapter connector is used to connect the connectors respectively provided on two circuit boards to increase the distance between the two circuit boards, it can not meet the requirement of use. Moreover, as an intermediate adapter connector between the two connectors, because of the long terminals, the crosstalk is increased in the signal transmission path, and the signal integrity and signal transmission speed are reduced, therefore, in order to further improve the signal transmission speed, further creation and improvement are needed to suppress and reduce crosstalk of signal transmission, reduce terminal impedance, and enhance shielding between signal terminals. Also, as an intermediate adapter connector between two connectors having the same configurations, there is a need for innovation and improvement different from the prior art construction. Also, as an intermediate adapter connector between two connectors having a mating port with a convex-concave mating structure, there is a need for innovation and improvement from the prior art construction.

SUMMARY OF THE PRESENT DISCLOSURE

Therefore, an object of the present disclosure is to provide an intermediate adapter connector configured to connect two connectors.

Therefore, another object of the present disclosure is to provide an electrical connector assembly which comprises two connectors and an intermediate adapter connector connecting the two connectors.

Accordingly, in some embodiments, an intermediate adapter connector of the present disclosure adapted to electrically connect a first connector and a second connector, the intermediate adapter connector comprise a first mating port, a second mating port, a plurality of insulating spacers and a plurality of terminal modules. The first mating port is configured to mate with the first connector; the second mating port is configured to mate with the second connector; the plurality of terminal modules are alternately arranged and stacked with the plurality of insulating spacers in a first direction, such that each terminal module is positioned between two adjacent insulating spacers; each terminal module comprises a terminal plate and a shield plate which are stacked in the first direction, the terminal plate has a plurality of conductive terminals arranged in a second direction, each conductive terminal has a first contact portion positioned at the first mating port and a second contact portion positioned at the second mating port.

In some embodiments, the plurality of insulating spacers and the plurality of terminal modules together form the first mating port and the second mating port at opposite sides in a third direction perpendicular to the first direction and the second direction, and the first mating port and the second mating port each have a plurality of protruding strips extending in the second direction and a plurality of slots recessed inwardly relative to the plurality of protruding strips, and the plurality of protruding strips and the plurality of slots are alternately arranged in the first direction.

In some embodiments, the first contact portion and the second contact portion of each conductive terminal are elastic contact portions and are respectively positioned at the first mating port and the second mating port, and a tip of the first contact portion and a tip of the second contact portion of each terminal module face opposite directions in the first direction, and the tips of the first contact portions of the conductive terminals of the adjacent terminal modules face the opposite directions in the first direction and the tips of the second contact portions of the conductive terminals of the adjacent terminal modules face the opposite direction in the first direction.

In some embodiments, overall arrangement and shape of the protruding strips and the slots of the first mating port is the same as with the second mating port but is opposite in position in the first direction.

In some embodiments, one side of each insulating spacer in the third direction is formed with a spacing strip correspondingly forming one protruding strip and the other side of each insulating spacer in the third direction is not formed with a spacing strip to correspondingly form the slot, each spacing strip has a plurality of receiving grooves, the tips of the first contact portions of the conductive terminals of each terminal module face the spacing strip of an adjacent insulating spacer and are received in the receiving grooves correspondingly, the tips of the second contact portions of the conductive terminals of each terminal module face the spacing strip of an adjacent insulating spacer and are received in the receiving grooves correspondingly.

In some embodiments, there are at least two groups of the insulating spacers having the same configurations but provided at different directions in the plurality of insulating spacers, there are at least two groups of the terminal modules having the same configurations but provided at different directions.

In some embodiments, the plurality of conductive terminals of each terminal module are composed of a plurality of ground terminals and a plurality of signal terminal pairs, and the plurality of ground terminals and the plurality of signal terminal pairs are alternately arranged in the second direction, the shield plate of each terminal module is mechanically and electrically connected with the plurality of ground terminals.

In some embodiments, the terminal plate of each terminal module further has a plate body which is insulative, and the plurality of conductive terminals are embedded in the plate body, the shield plate is engaged with a plate surface of the plate body.

In some embodiments, a width of each ground terminal in the second direction is greater than a width between opposite outer sides of each signal terminal pair in the second direction, and positions of the signal terminal pairs of the adjacent terminal modules are staggered and are not overlapped in the first direction, each signal terminal pair of one of two adjacent terminal modules is positioned within a range covered by the width of the corresponding ground terminal of the other of the adjacent terminal modules in the first direction.

In some embodiments, the plurality of insulating spacers each are formed with limiting blocks respectively at four corners of each insulating spacer, four corners of each terminal plate interposed between the insulating spacers each are formed with a notch providing a space to allow the corresponding limiting block of each insulating spacer to be placed in.

In some embodiments, the two limiting blocks which correspond to each other in position in some adjacent insulating spacers are formed with a recessed groove and a protruding block which are complementarily cooperated.

In some embodiments, the plate body of each terminal plate has a plate piece and two edge strips, the two edge strips are positioned at two opposite edges of the plate piece along the second direction, a width between two opposite plate edges of a main body of each insulating spacer along the second direction is smaller than a width between the two edge strips of the plate body of each terminal plate, when the plurality of terminal modules and the plurality of insulating spacers are stacked, the two plate edges of the main body of the insulating spacer are limited between the edge strips of the plate bodies of the adjacent terminal plates in the second direction.

In some embodiments, the main bodies of some of the plurality of insulating spacers are formed with positioning blocks protruding along the second direction, the edge strips of the plate body of each terminal plate are formed with inserting grooves corresponding to the positioning blocks, when the plurality of terminal modules and the plurality of insulating spacers are stacked, the positioning block of the insulating spacers is accommodated in a space formed by the inserting grooves of the adjacent terminal plates.

In some embodiments, both sides of at least outermost two of the plurality of insulating spacers along the second direction are formed with a plurality of clipping blocks, and both sides of each terminal plate along the second direction are formed with a plurality of clipping blocks, and the clipping blocks of each terminal plate and the clipping blocks of an adjacent insulating spacer and the clipping blocks of another adjacent terminal plate are staggered along the third direction, the intermediate adapter connector further comprises a plurality of connecting plates, the plurality of connecting plate each have a plurality of clipping holes respectively corresponding to the clipping blocks and are respectively provided at two sides of the plurality of insulating spacers and the plurality of terminal modules along the second direction after the plurality of insulating spacers and the plurality of terminal modules are stacked, so as to fix a combination of the plurality of insulating spacers and the plurality of terminal modules.

Accordingly, in some embodiments, an electrical connector assembly of the present disclosure comprises a first connector, a second connector and an intermediate adapter connector. The first connector is configured to mount on a first circuit board; the second connector is configured to mount on a second circuit board; and the intermediate adapter connector is configured to mate with the first connector and the second connector to electrically connect the first connector and the second connector, the intermediate adapter connector comprises a first mating port, a second mating port, a second mating port and a plurality of terminal modules. The first mating port is configured to mate with the first connector; the second mating port is configured to mate with the second connector; the plurality of terminal modules are alternately arranged and stacked with the plurality of insulating spacers in a first direction, such that each terminal module is positioned between two adjacent insulating spacers; each terminal module comprises a terminal plate and a shield plate which are stacked in the first direction, the terminal plate has a plurality of conductive terminals arranged in a second direction, each conductive terminal has a first contact portion positioned at the first mating port and a second contact portion positioned at the second mating port, the plurality of insulating spacers and the plurality of terminal modules together form the first mating port and the second mating port at opposite sides in a third direction perpendicular to the first direction and the second direction, the first mating port and the second mating port are configured to mate with the first connector and the second connector respectively.

In some embodiments, the first connector and the second connector have the same overall configurations and are capable of mating with each other, a configuration of the first mating port corresponds to the second connector, a configuration of the second mating port corresponds to the first connector, so that the first mating port is capable of mating with the first connector and the second mating port is capable of mating with the second connector.

In some embodiments, the first mating port and the second mating port each have a plurality of protruding strips extending in the second direction and a plurality of slots recessed inwardly relative to the plurality of protruding strips, and the plurality of protruding strips and the plurality of slots are alternately arranged in the first direction.

In some embodiments, the first contact portion and the second contact portion of each conductive terminal are elastic contact portions and are respectively positioned at the first mating port and the second mating port, and a tip of the first contact portion and a tip of the second contact portion of each terminal module face opposite directions in the first direction, and the tips of the first contact portions of the conductive terminals of the adjacent terminal modules face the opposite directions in the first direction and the tips of the second contact portions of the conductive terminals of the adjacent terminal modules face the opposite direction in the first direction.

In some embodiments, overall arrangement and shape of the protruding strips and the slots of the first mating port is the same as with the second mating port but is opposite in position in the first direction.

In some embodiments, one side of each insulating spacer in the third direction is formed with a spacing strip correspondingly forming one protruding strip and the other side of each insulating spacer in the third direction is not formed with a spacing strip to correspondingly form the slot, each spacing strip has a plurality of receiving grooves, the tips of the first contact portions of the conductive terminals of each terminal module face the spacing strip of an adjacent insulating spacer and are received in the receiving grooves correspondingly, the tips of the second contact portions of the conductive terminals of each terminal module face the spacing strip of an adjacent insulating spacer and are received in the receiving grooves correspondingly.

In some embodiments, there are at least two groups of the insulating spacers having the same configurations but provided at different directions in the plurality of insulating spacers, there are at least two groups of the terminal modules having the same configurations but provided at different directions.

In some embodiments, the plurality of conductive terminals of each terminal module are composed of a plurality of ground terminals and a plurality of signal terminal pairs, and the plurality of ground terminals and the plurality of signal terminal pairs are alternately arranged in the second direction, the shield plate of each terminal module is mechanically and electrically connected with the plurality of ground terminals.

In some embodiments, the terminal plate of each terminal module further has a plate body which is insulative, and the plurality of conductive terminals are embedded in the plate body, the shield plate is engaged with a plate surface of the plate body.

In some embodiments, a width of each ground terminal in the second direction is greater than a width between opposite outer sides of each signal terminal pair in the second direction, and positions of the signal terminal pairs of the adjacent terminal modules are staggered and are not overlapped in the first direction, each signal terminal pair of one of two adjacent terminal modules is positioned within a range covered by the width of the corresponding ground terminal of the other of the adjacent terminal modules in the first direction.

In some embodiments, the plurality of insulating spacers each are formed with limiting blocks respectively at four corners of each insulating spacer, four corners of each terminal plate interposed between the insulating spacers each are formed with a notch providing a space to allow the corresponding limiting block of each insulating spacer to be placed in.

In some embodiments, the two limiting blocks which correspond to each other in position in some adjacent insulating spacers are formed with a recessed groove and a protruding block which are complementarily cooperated.

In some embodiments, both sides of at least outermost two of the plurality of insulating spacers along the second direction are formed with a plurality of clipping blocks, and both sides of each terminal plate along the second direction are formed with a plurality of clipping blocks, and the clipping blocks of each terminal plate and the clipping blocks of an adjacent insulating spacer and the clipping blocks of another adjacent terminal plate are staggered along the third direction, the intermediate adapter connector further comprises a plurality of connecting plates, the plurality of connecting plate each have a plurality of clipping holes respectively corresponding to the clipping blocks and are respectively provided at two sides of the plurality of insulating spacers and the plurality of terminal modules along the second direction after the plurality of insulating spacers and the plurality of terminal modules are stacked, so as to fix a combination of the plurality of insulating spacers and the plurality of terminal modules.

In some embodiments, the first connector and the second connector are mezzanine connectors.

The present disclosure at least has the following effects: in the intermediate adapter connector, by that a plurality of insulating spacers and a plurality of terminal modules are alternately stacked to form a main structure, and the shielding plate of each terminal module can cover a very large part of the plurality of conductive terminals (including a portion of the first contact portion and a portion of the second contact portion), and thus can provide comprehensive shielding between the conductive terminals f the adjacent terminal modules, which can shield the signal interference more effectively.

In addition, there are insulating spacers having the same configurations but provided at different directions in the plurality of insulating spacers, and there are terminal modules having the same configurations but provided at different directions in the plurality of terminal module, and the overall combine structure is simplified in the structure in which the number of terminals arranged varies, which is not only convenient to manufacture to reduce manufacturing cost, but also has more flexible expansion performance. Moreover, the first mating port and second mating port of the intermediate adapter connector have the same configurations, and are capable of connecting the first connector and the second connector which have the same configurations.

BRIEF DESCRIPTION OF THE FIGURES

Other features and effects of the present disclosure will be apparent from the embodiments in combination with the accompanying figures in which.

Figure 1:
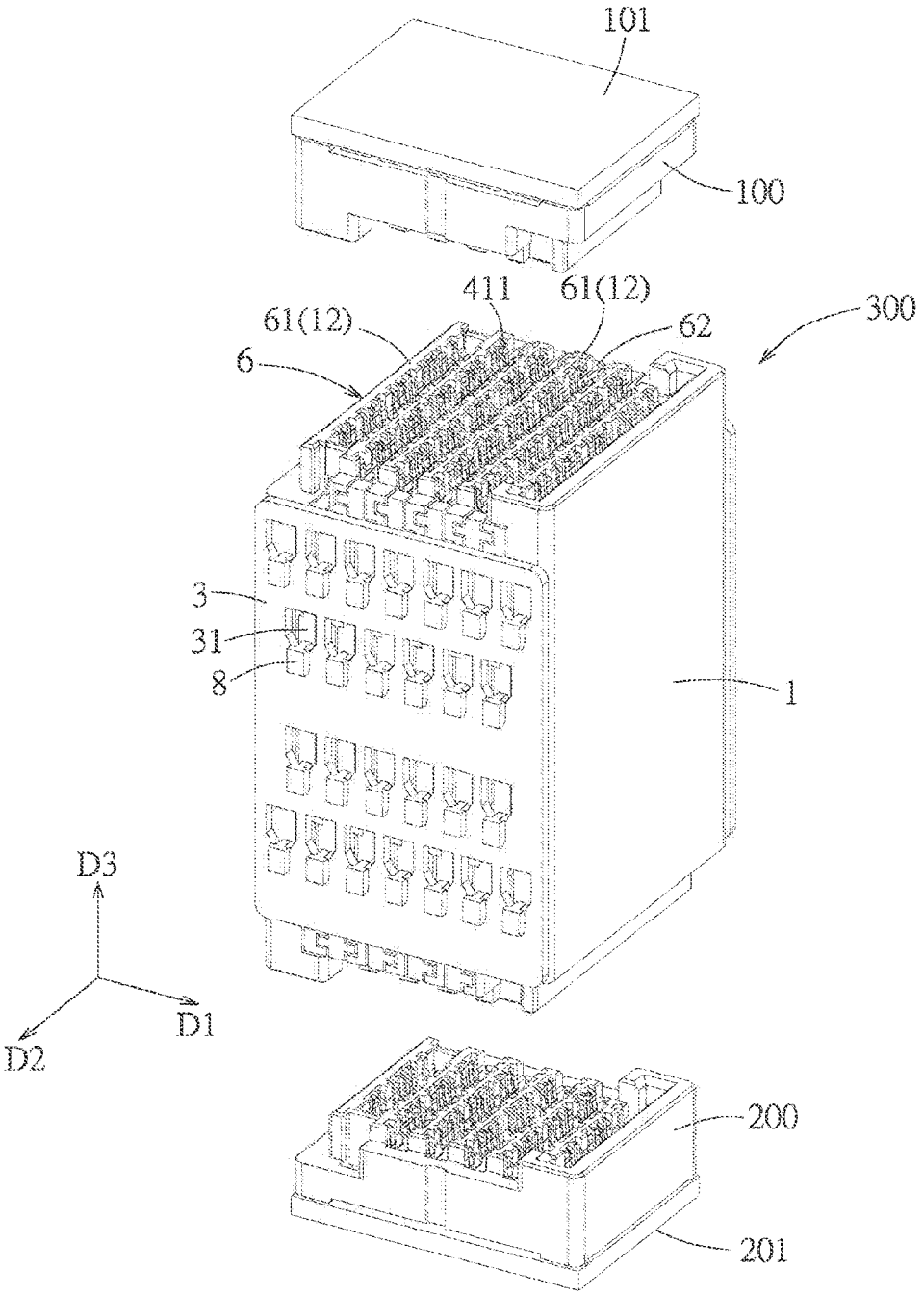
FIG. 1 is an exploded perspective view of an embodiment of an electrical connector assembly of the present disclosure illustrating a mating relationship between an intermediate adapter connector and a first connector and a second connector.

The reference numerals are as follows:

100 first connector
101 first circuit board
200 second connector
201 second circuit board
300 intermediate adapter connector
1 insulating spacer
1A first type insulating spacer
1B second type insulating spacer
1C third type insulating spacer
1D fourth type insulating spacer
11 main body
111 plate edge
12 spacing strip
121 receiving groove
13*a*, 13*b*, 13*c*, 13*d* limiting block
131 recessed groove
132 protruding block
14 positioning block
2 terminal module
2A first type terminal module
2B second type terminal module
3 connecting plate
31 clipping hole
4 terminal plate
41 conductive terminal
411 first contact portion
412 second contact portion
413 body portion
414 contact hole
42 plate body
421 inserting groove
422 notch
423 engaging post
424 ground terminal exposing hole
425 signal terminal exposing window
426 edge strip
5 shield plate
51 hole
53 contact finger
54 engaging hole
6 first mating port
6' second mating port
61 protruding strip
62 slot
7 side face
8 clipping block
D1 first direction
D2 second direction
D3 third direction
G ground terminal
S signal terminal pair

DETAILED DESCRIPTION

Figure 2:
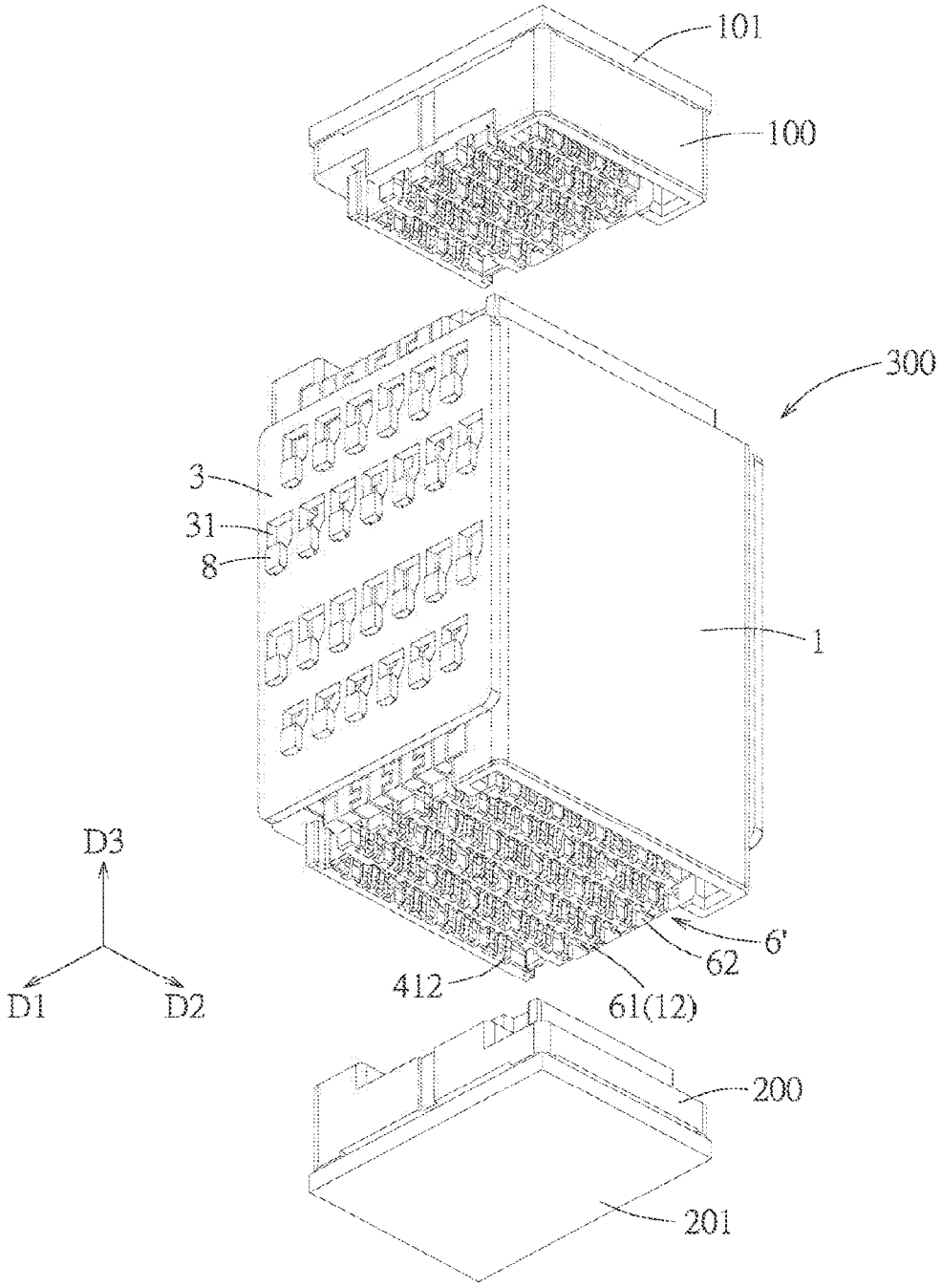
FIG. 2 is a view of FIG. 1 from another angle.
Figure 3:
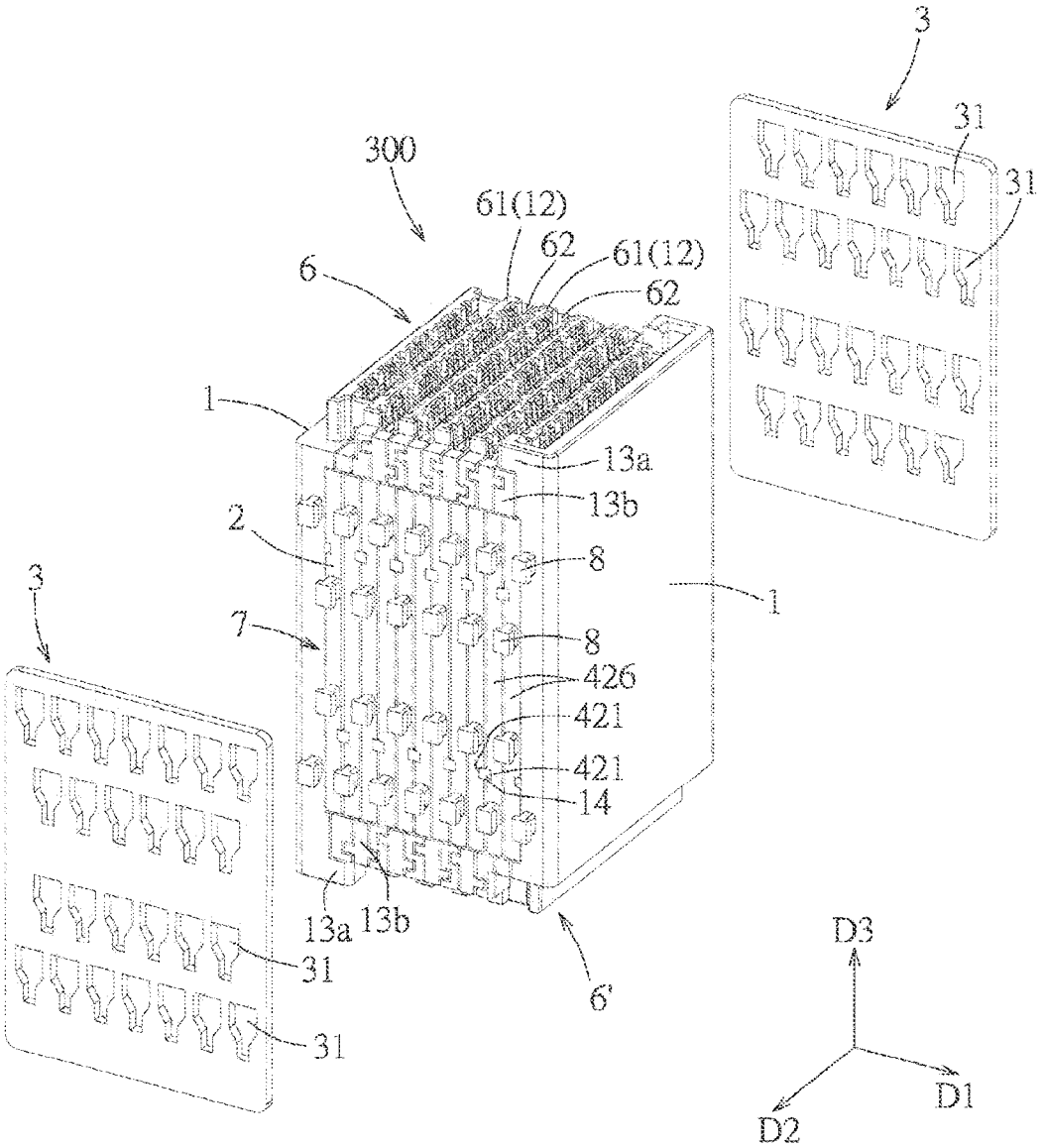
FIG. 3 is an exploded perspective view of the intermediate adapter connector of the embodiment.
Figure 4:
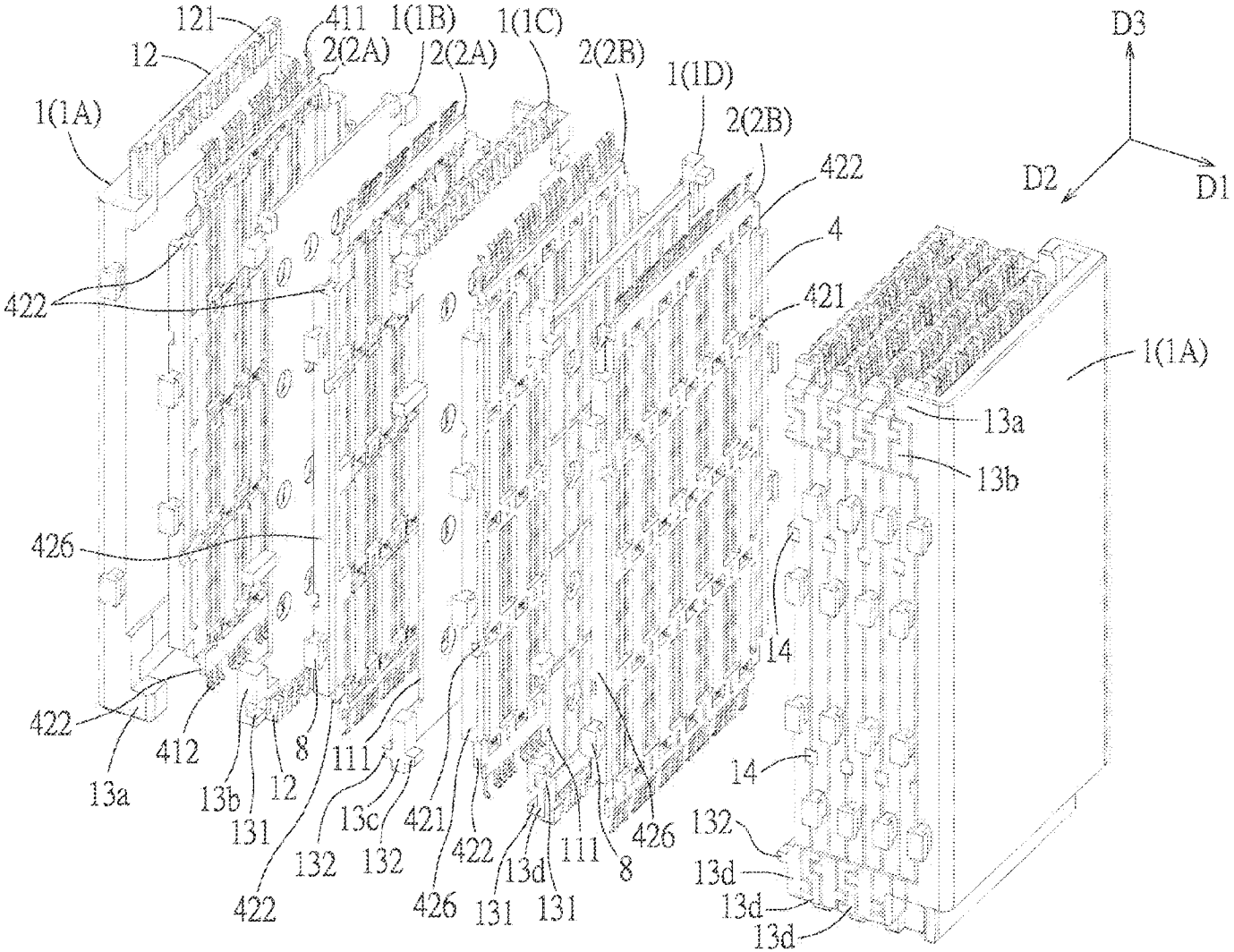
FIG. 4 is a partially exploded perspective view of the intermediate adapter connector, in which the two connecting plates are not shown.

Referring to FIG. 1 and FIG. 2, an embodiment of an electrical connector assembly of the present disclosure comprises a first connector 100, a second connector 200, and an intermediate adapter connector 300. The first connector 100 is configured to mount on a first circuit board 101. The second connector 200 is configured to mount on a second circuit board 201. The intermediate adapter connector 300 is configured to mate with the first connector 100 and the second connector 200 so as to electrically connect the first connector 100 and the second connector 200, and the intermediate adapter connector 300 has a first mating port 6 configured to mate with the first connector 100 and a second mating port 6' configured to mate with the second connector 200. In the embodiment, the first connector 100 and the second connector 200 have the same overall configurations and are capable of mating with each other face-to-face, for example, the first connector 100 and the second connector 200 are mirror mezzanine connectors with the same configurations.

Figure 6:
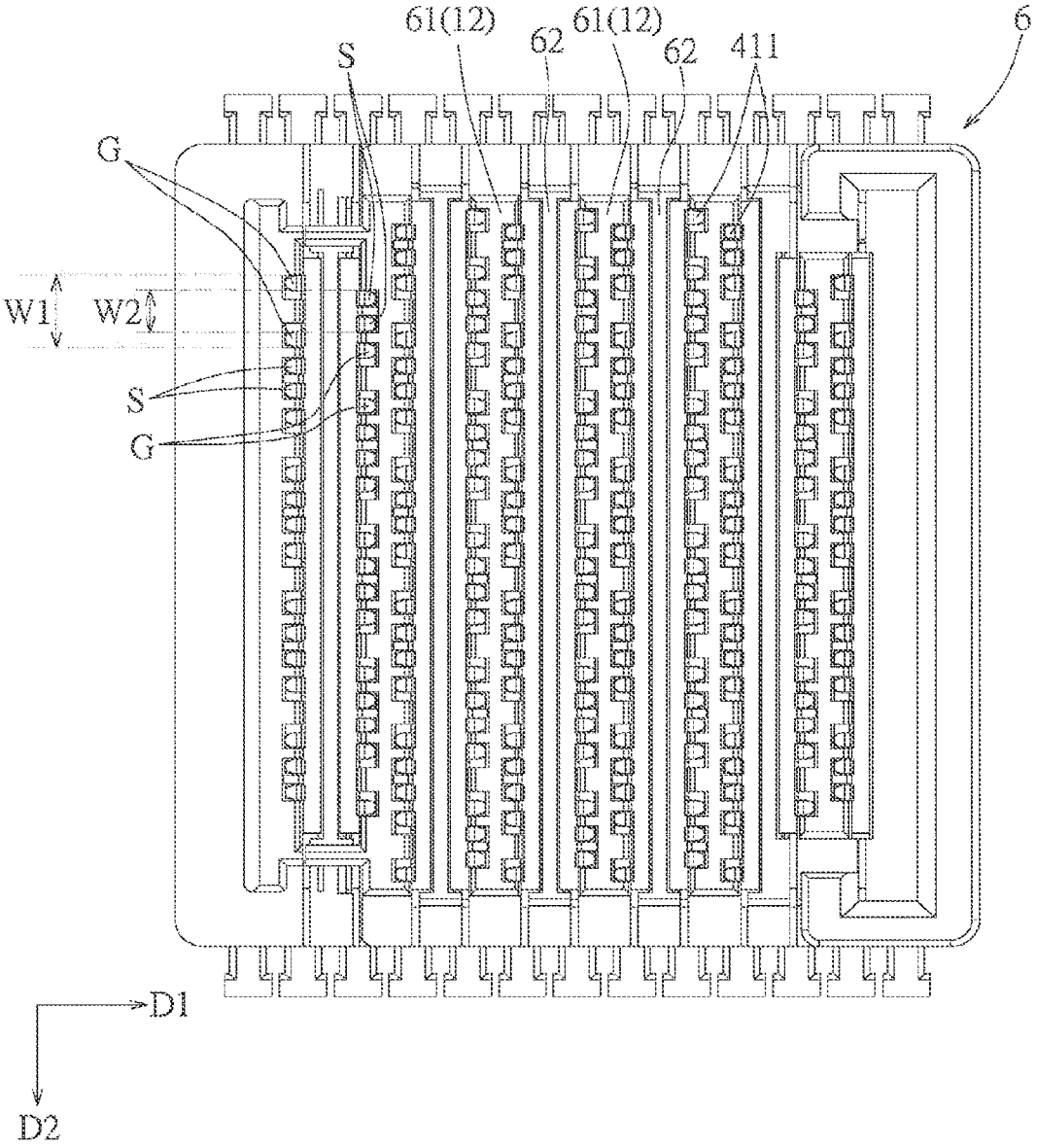
FIG. 6 is a top view of the intermediate adapter connector.
Figure 7:
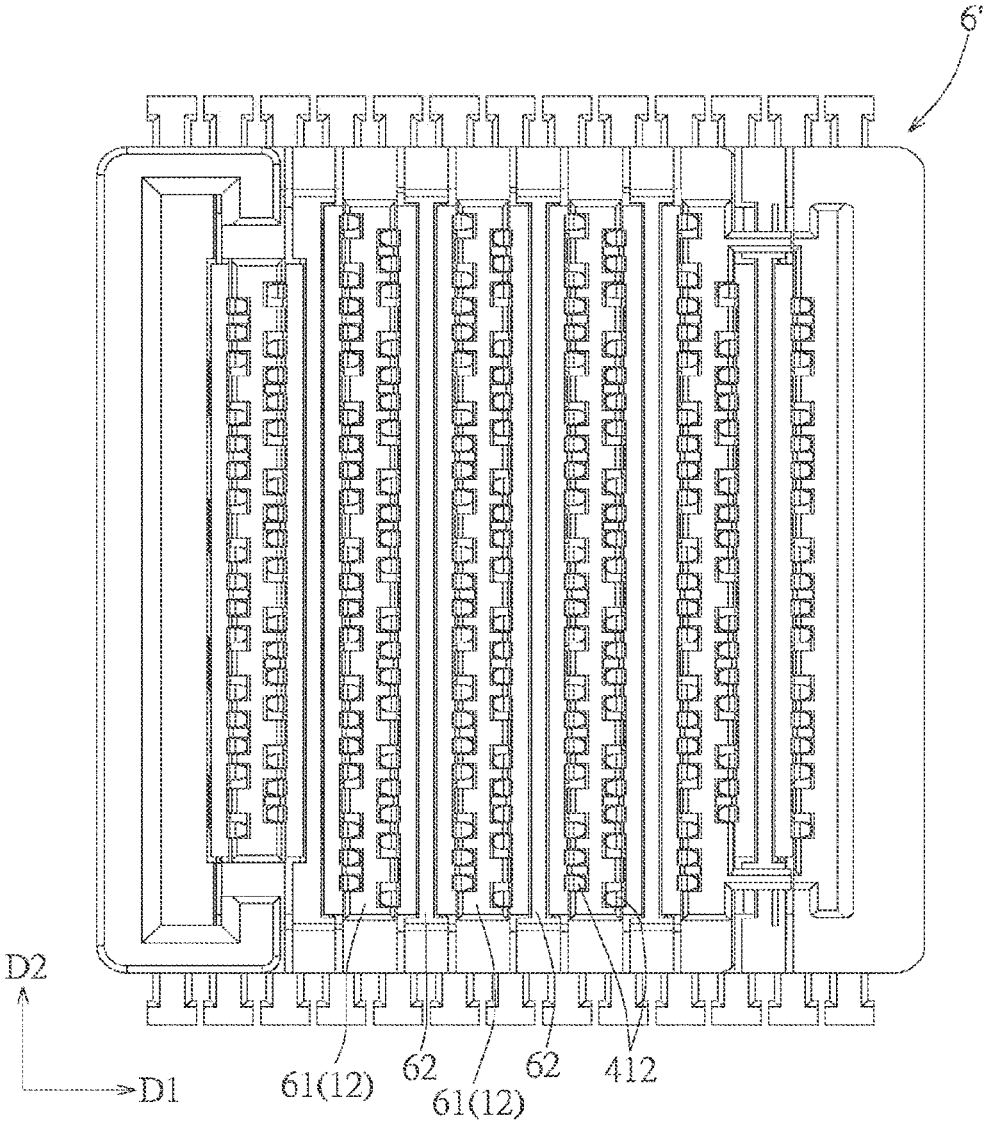
FIG. 7 is a bottom view of the intermediate adapter connector.

Referring to FIG. 3 and FIG. 5*a* to FIG. 5*c*, the intermediate adapter connector 300 comprises a plurality of insulating spacers 1, a plurality of terminal modules 2 and a plurality of connecting plates 3. The plurality of terminal modules 2 and the plurality of insulating spacers 1 are alternately arranged in a first direction D1 such that each terminal module 2 is positioned between the two adjacent insulating spacers 1. And, the plurality of insulating spacers 1 and the plurality of terminal modules 2 together form the first mating port 6 and the second mating port 6' on opposite sides in a third direction D3 perpendicular to a first direction D1. Referring to FIG. 6 and FIG. 7, the first mating port 6 and the second mating port 6' each have a plurality of protruding strips 61 extending in a second direction D2 perpendicular to the first direction D1 and the third direction D3 and a plurality of slots 62 recessed inwardly relative to the plurality of protruding strips 61, and the plurality of protruding strips 61 and the plurality of slots 62 are alternately arranged in the first direction D1. For sake of the convenient description, in the embodiment, a direction indicated by an arrow of the first direction D1 is front, a direction opposite to the direction indicated by the arrow of the first direction D1 is rear, a direction indicated by an arrow of the second direction D2 is left, a direction opposite to the direction indicated by the arrow of the second direction D2 is right, a direction indicated by an arrow of the third direction D3 is up, and a direction opposite to the direction indicated by the arrow of the third direction D3 is down. A configuration of the first mating port 6 corresponds to the second connector 200 (see FIG. 1), that is, an arrangement of the protruding strips 61 and the slots 62 of the first mating port 6 is the same as the second connector 200, so that the first mating port 6 is capable of mating with the first connector 100, and a configuration of the second mating port 6' corresponds to the first connector 100 (see FIG. 2), that is, an arrangement of the protruding strips 61 and the slots 62 of the second mating port 6' is the same as the first connector 100, so that the second mating port 6' is capable of mating with the second connector 200. In the embodiment, the first mating port 6 faces upwardly, the second mating port 6' faces downwardly, and overall arrangement and shape of the protruding strips 61 and the slots 62 of the first mating port 6 is the same as the second mating port 6' but is opposite in position in a first direction D1.

Figure 8:
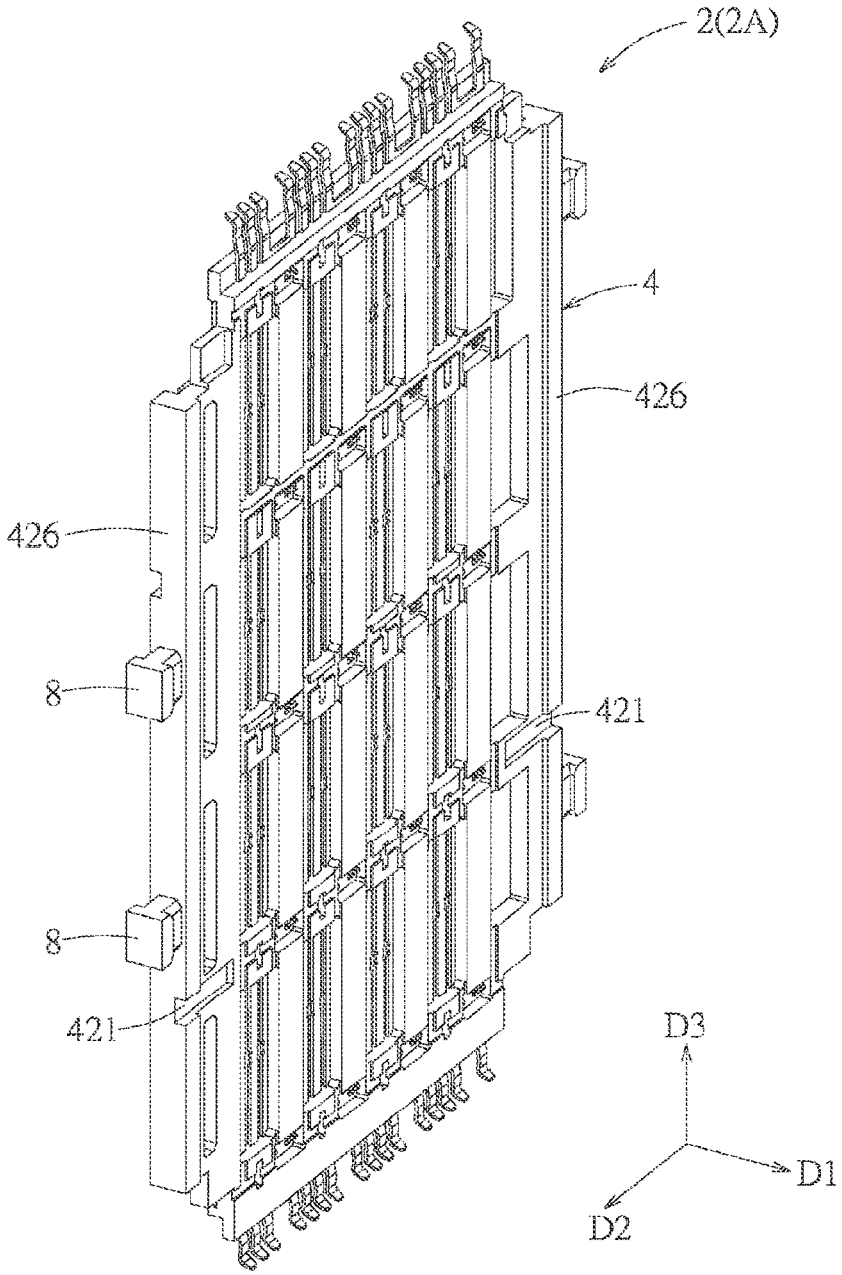
FIG. 8 is a perspective view of a first type terminal module of the intermediate adapter connector.
Figure 9:
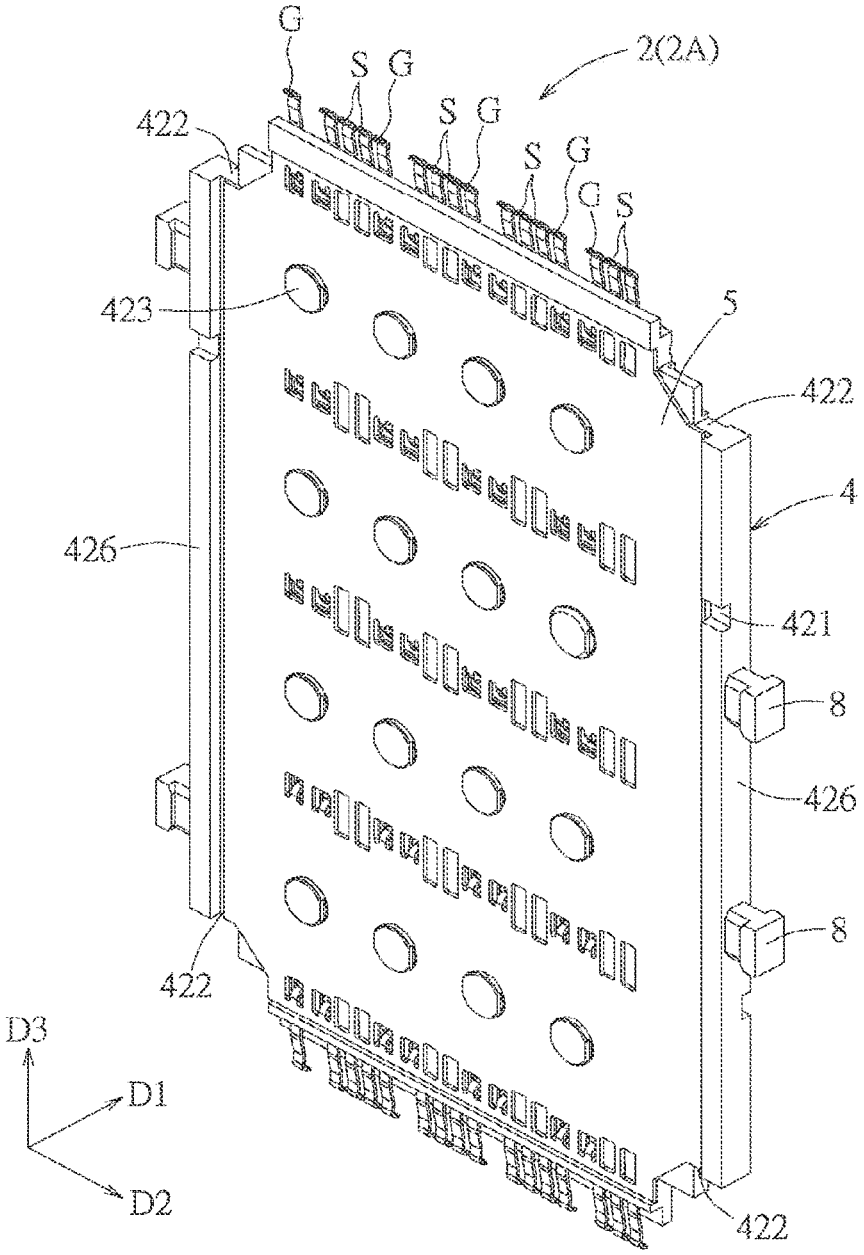
FIG. 9 is a view of FIG. 8 from another angle.
Figure 10:
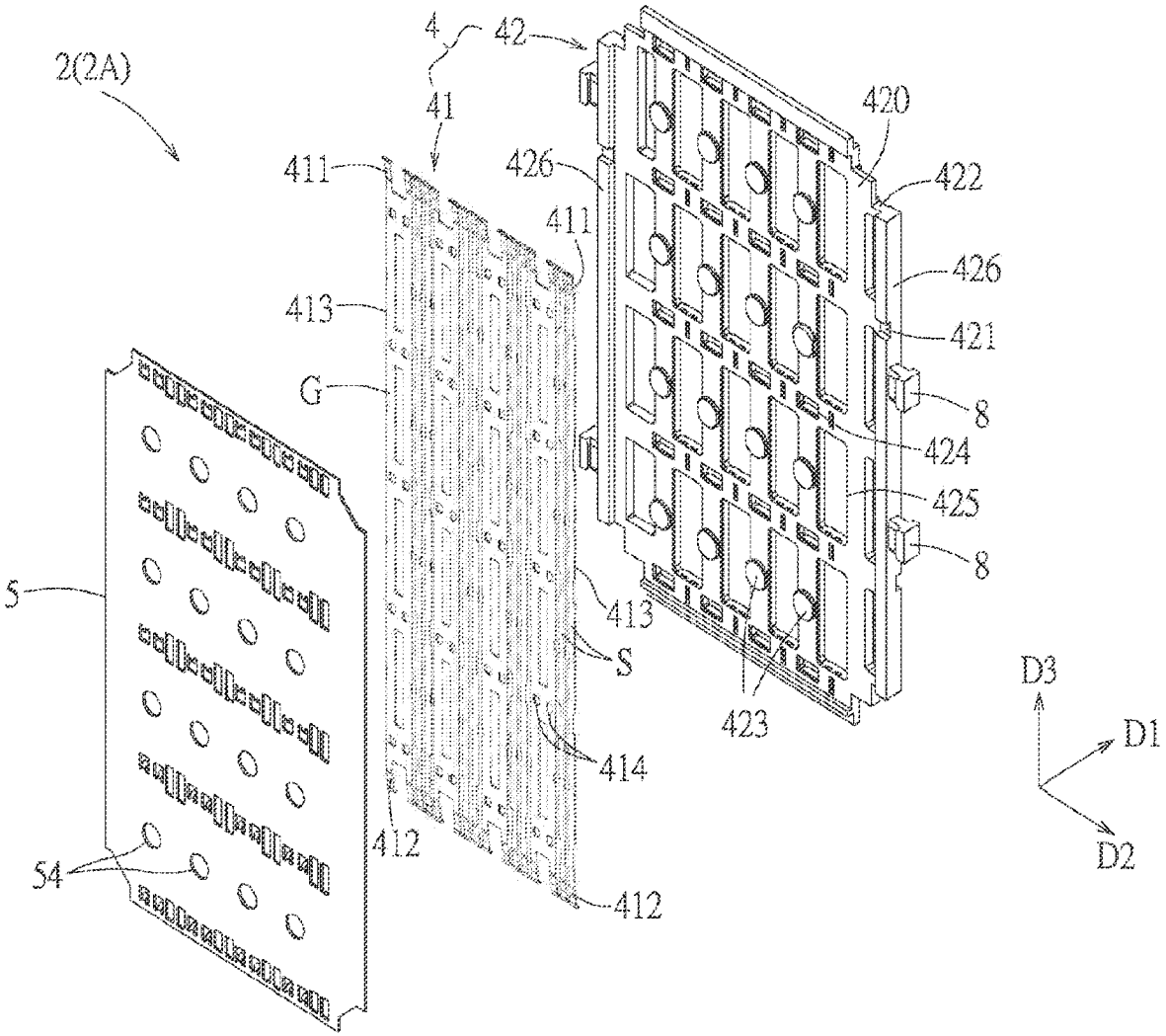
FIG. 10 is an exploded perspective view corresponding to FIG. 9.
Figure 11:
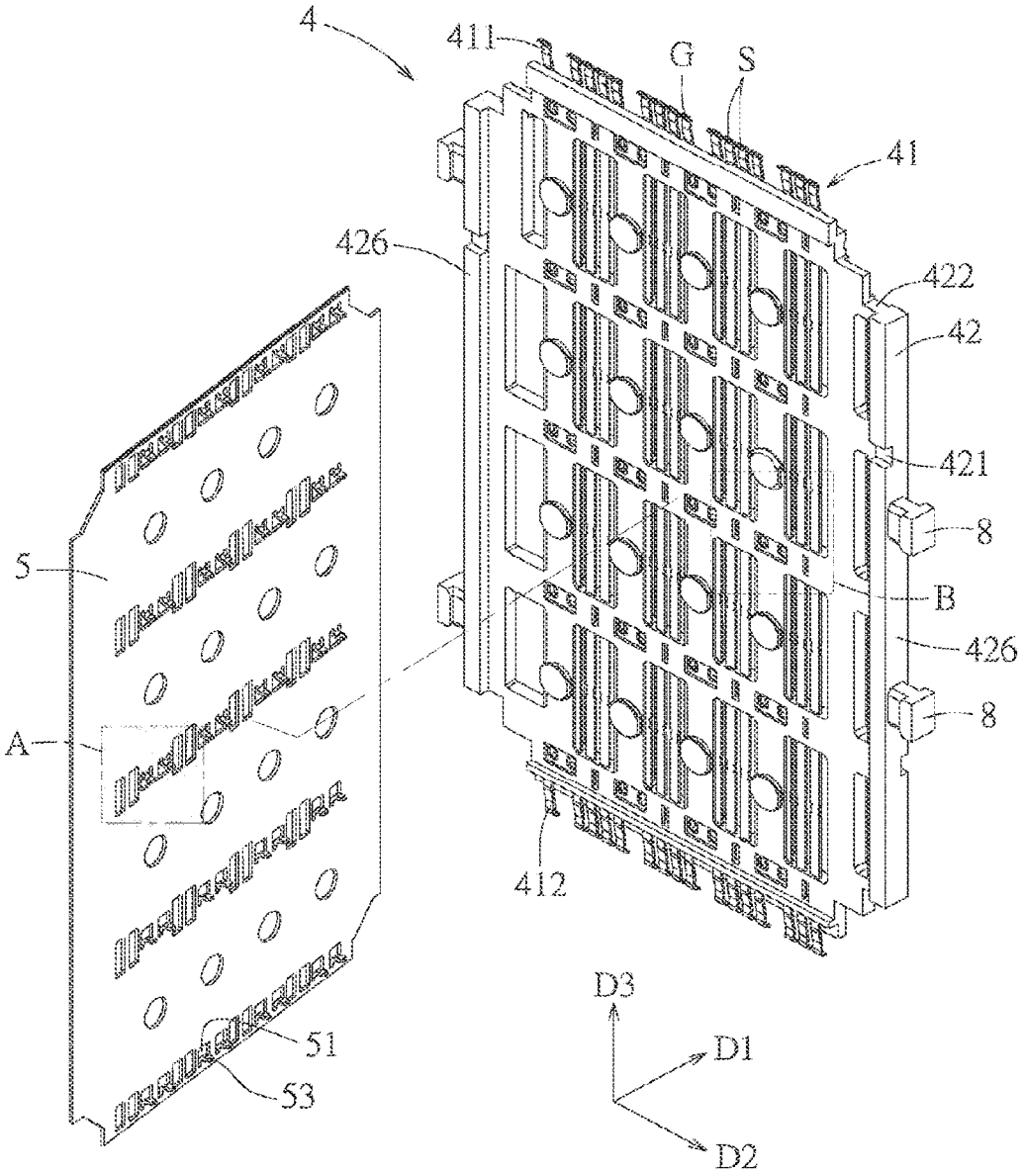
FIG. 11 is another exploded perspective view of the first type terminal module.
Figure 12:
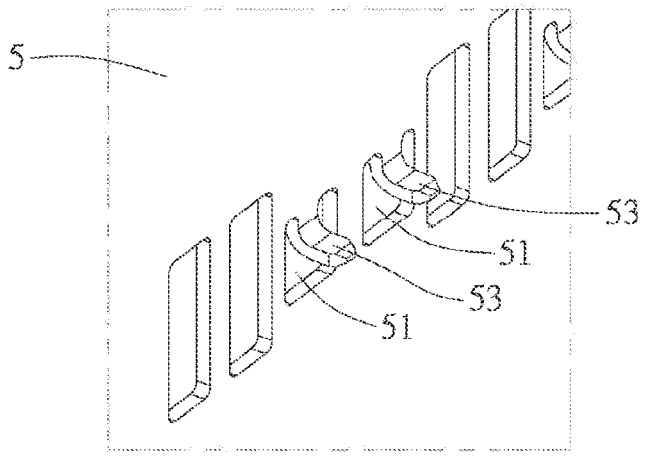
FIG. 12 is an enlarged view of a part of FIG. 11 indicated by A.
Figure 13:
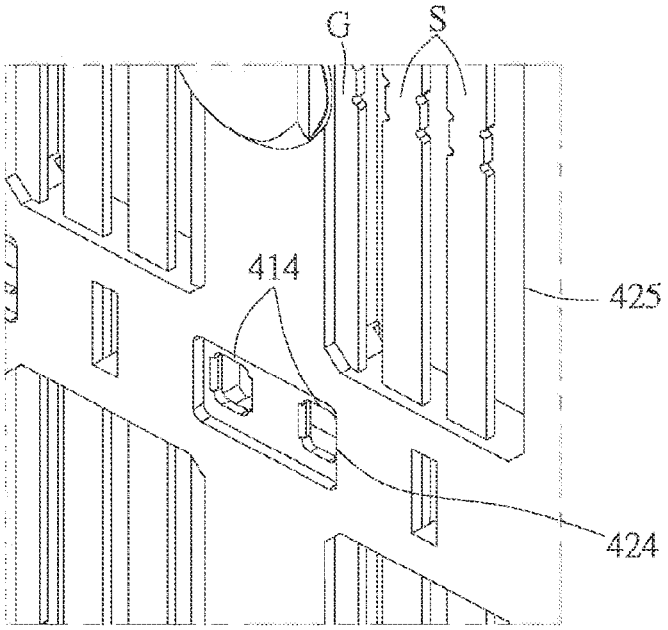
FIG. 13 is an enlarged view of a part of FIG. 11 indicated by B.

Referring to FIG. 8 to FIG. 10, each terminal module 2 comprises a terminal plate 4 and a shield plate 5 which are stacked in the first direction D1. The terminal plate 4 has a plurality of conductive terminals 41 arranged in the second direction D2 which is parallel to a plate surface of the terminal plate 4, each conductive terminal 41 has a first contact portion 411 and the second contact portion 412 which are positioned at opposite ends in the third direction D3 and a body portion 413 which connects the first contact portion 411 and the second contact portion 412. The first contact portion 411 is positioned at the first mating port 6 (see FIG. 1) and the second contact portion 412 is positioned at the second mating port 6' (see FIG. 2). A tip of the first contact portion 411 and a tip of the second contact portion 412 face opposite directions in the first direction D1. In the embodiment, the terminal plate 4 of each terminal module 2 further has a plate body 42 which is insulative, and the plurality of conductive terminals 41 are embedded in the plate body 42, that is, the plurality of conductive terminals 41 are engaged with and fixed to the plate body 42 by an insert molding method. In the embodiment, the plate body 42 has a plate piece 420 and two edge strips 426, the two edge strips 426 are respectively positioned at left and right edges of the plate piece 420 and extend in an up-down direction, and a thickness of the edge strip 426 in a front-rear direction is more than a thickness of the plate piece 420 in a front-rear direction. The shield plate 5 is engaged with a plate surface of the plate piece 420 of the plate body 42 positioned at the rear of a direction which can be seen from the figure. Specifically, the plate surface of the plate body 42 facing the shielding plate 5 is formed with a plurality of engaging posts 423 which protrude, the shielding plate 5 is made of a metal material and has an area which can covers the body portions 413 of the plurality of conductive terminals 41, portions which each are connected between the first contact portion 411 and the body portion 413 and portions which each are connected between the second contact portion 412 and the body portion 413, the shielding plate 5 is formed with a plurality of engaging holes 54 which respectively correspond to the plurality of engaging posts 423, by that the plurality of engaging posts 423 are respectively inserted into the plurality of engaging holes 54 and then tips of the plurality of engaging posts 423 are hot melted and deformed, the plurality of engaging posts 423 are not respectively detached from the plurality of engaging holes 54, so that the shielding plate 5 and the plate body 42 are engaged with each other and fixed together, in the embodiment, the shielding plate 5 is engaged with and fixed to the plate piece 420 and is positioned between the two edge strips 426.

Referring to FIG. 10 to FIG. 13, in the embodiment, the plurality of conductive terminals 41 of each terminal module 2 is composed of a plurality of ground terminal G and a plurality of signal terminal pairs S, and the plurality of ground terminals G and the plurality of signal terminal pairs S are alternately arranged in the second direction D2. The shield plate 5 of each terminal module 2 is mechanically and electrically connected with the plurality of ground terminals G. Specifically, the plate body 42 has a plurality of ground terminal exposing holes 424 which respectively expose the plurality of ground terminals G and a plurality of signal terminal exposing windows 425 which respectively expose the plurality of signal terminal pairs S, and because the plurality of conductive terminals 41 each are relative long in length, the plate body 42 has multiple ground terminal exposing holes 424 in the up-down direction (namely an extending direction of the terminal 41) with respect to each ground terminal G, similarly, the plate body 42 has multiple signal terminal exposing windows 425 in the up-down direction (namely the extending direction of the terminal 41) with respect to each signal terminal pair S. The shield plate 5 has a plurality of contact fingers 53 respectively bending and extending toward the plurality of ground terminals G, each contact finger 53 is defined by a stamped U-shaped hole 51 and is bent relative to the shield plate 5. The body portion 413 of each ground terminal G is formed with a plurality of contact holes 414 corresponding to the ground terminal exposing holes 424 and the contact fingers 53. In the embodiment, a region of the body portion 413 of each ground terminal G corresponding to each ground terminal exposing hole 424 of the plate body 42 has two contact holes 414, and the two contact holes 414 also correspond to the two contact fingers 53 of the shield plate 5, such that when the terminal plate 4 and the shield plate 5 are stacked, the plurality of contact fingers 53 pass through the corresponding ground terminal exposing holes 424 and extend into the corresponding contact holes 414 to contact hole edges of the plurality of contact holes 414, namely, the plurality of contact fingers 53 contact the ground terminals G, so the shielding plate 5 is mechanically and electrically connected with the plurality of ground terminals G. In the embodiment, a tip of each contact finger 53 is an arc shape, but in a variant embodiment, the tip of each contact finger 53 may also be a bifurcated shape, which is not limited to the embodiment. The shielding plate 5 can cover a very large part of the plurality of conductive terminals 41 (including a portion of the first contact portions 411 and a portion of the second contact portions 412), and thus can provide comprehensive shielding between the conductive terminals 41 of the adjacent terminal modules 2, which can shield the signal interference more effectively. Moreover, the signal terminal exposing window 425 of the plate body 42 exposes the two signal terminals of the signal terminal pair S so as to allow the two signal terminals of the signal terminal pair S to directly face the shield plate 5, which can assist on improvement of signal integrity.

Figure 14:
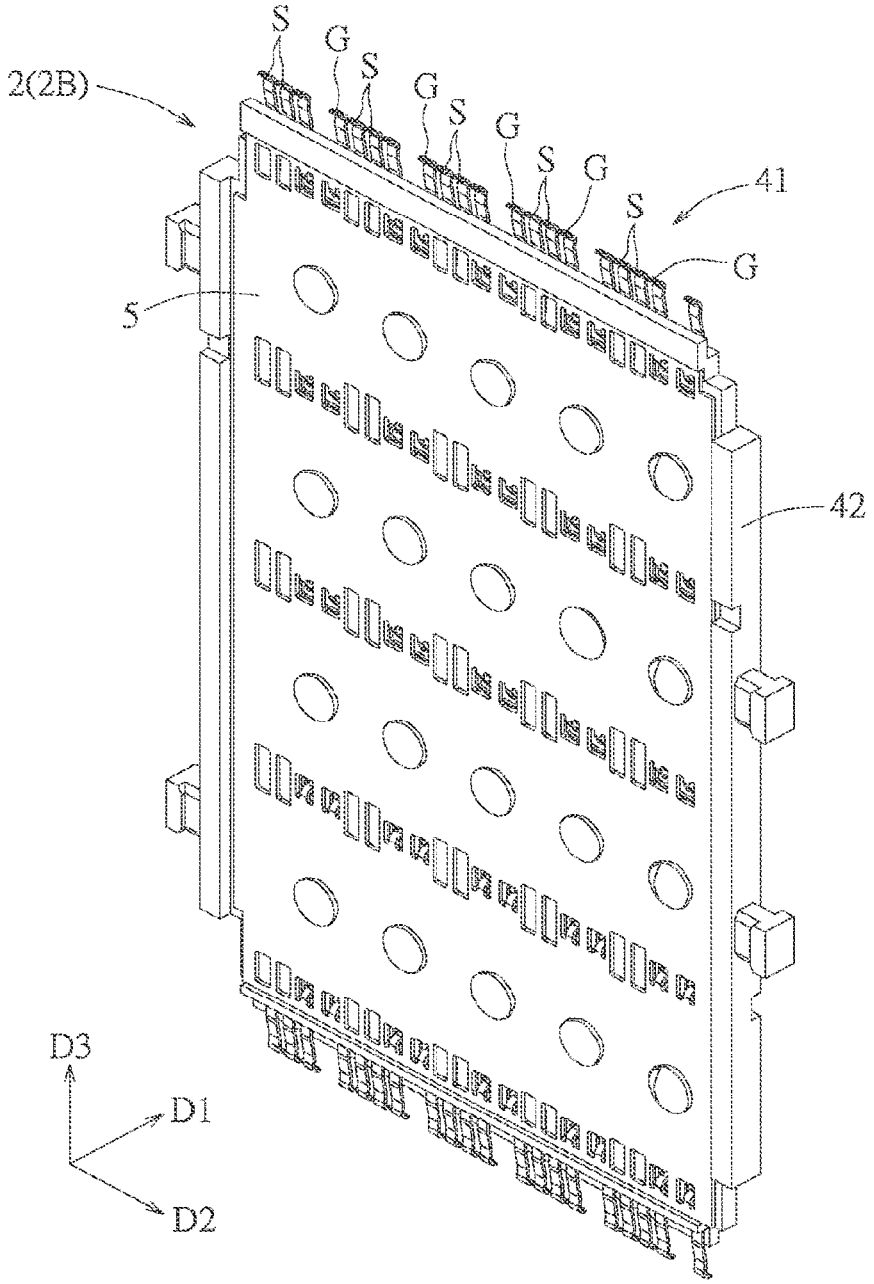
FIG. 14 is a perspective view of a second type terminal module of the intermediate adapter connector.
Figure 15:
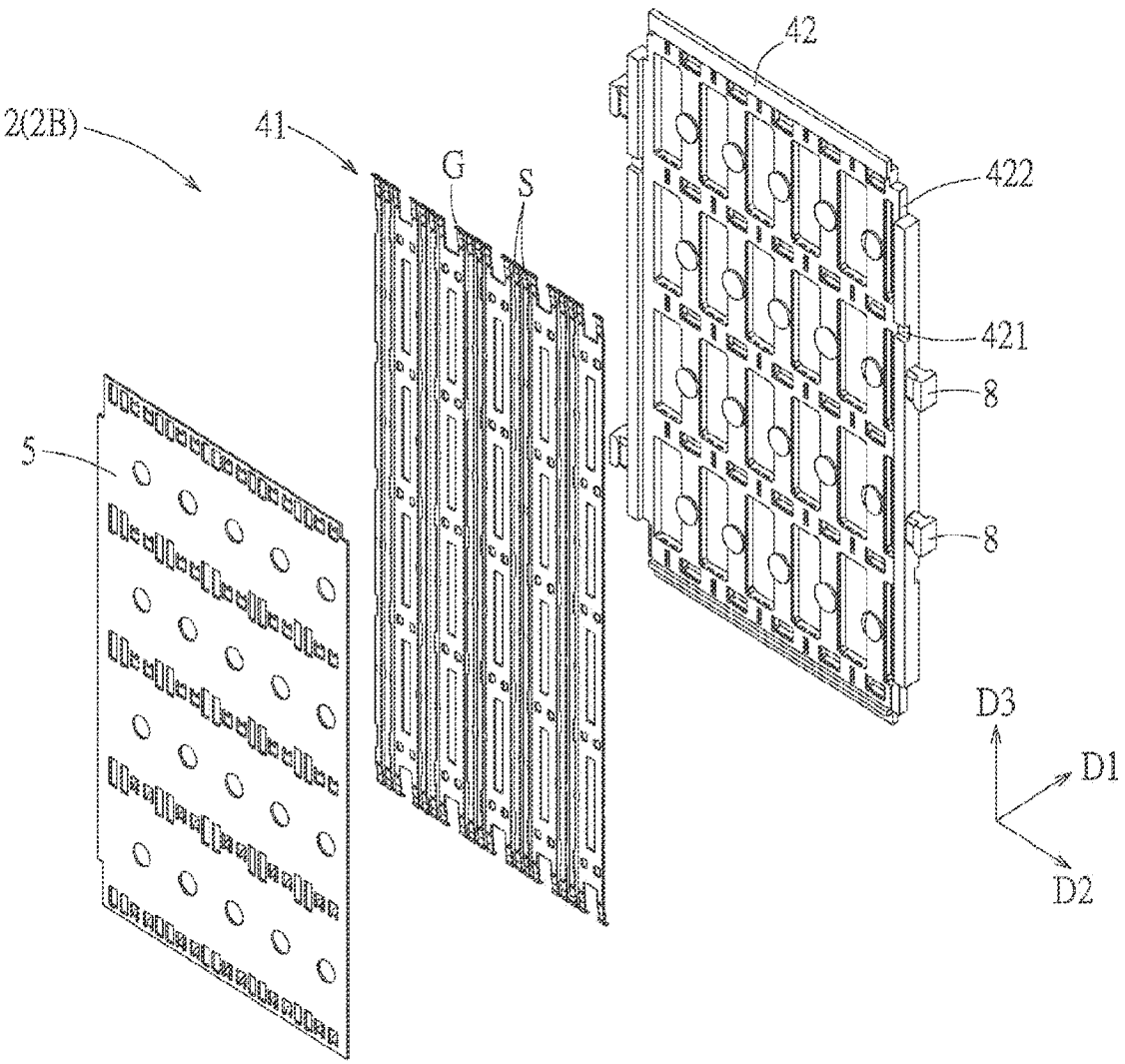
FIG. 15 is an exploded perspective view corresponding to FIG. 14.
Figure 16:
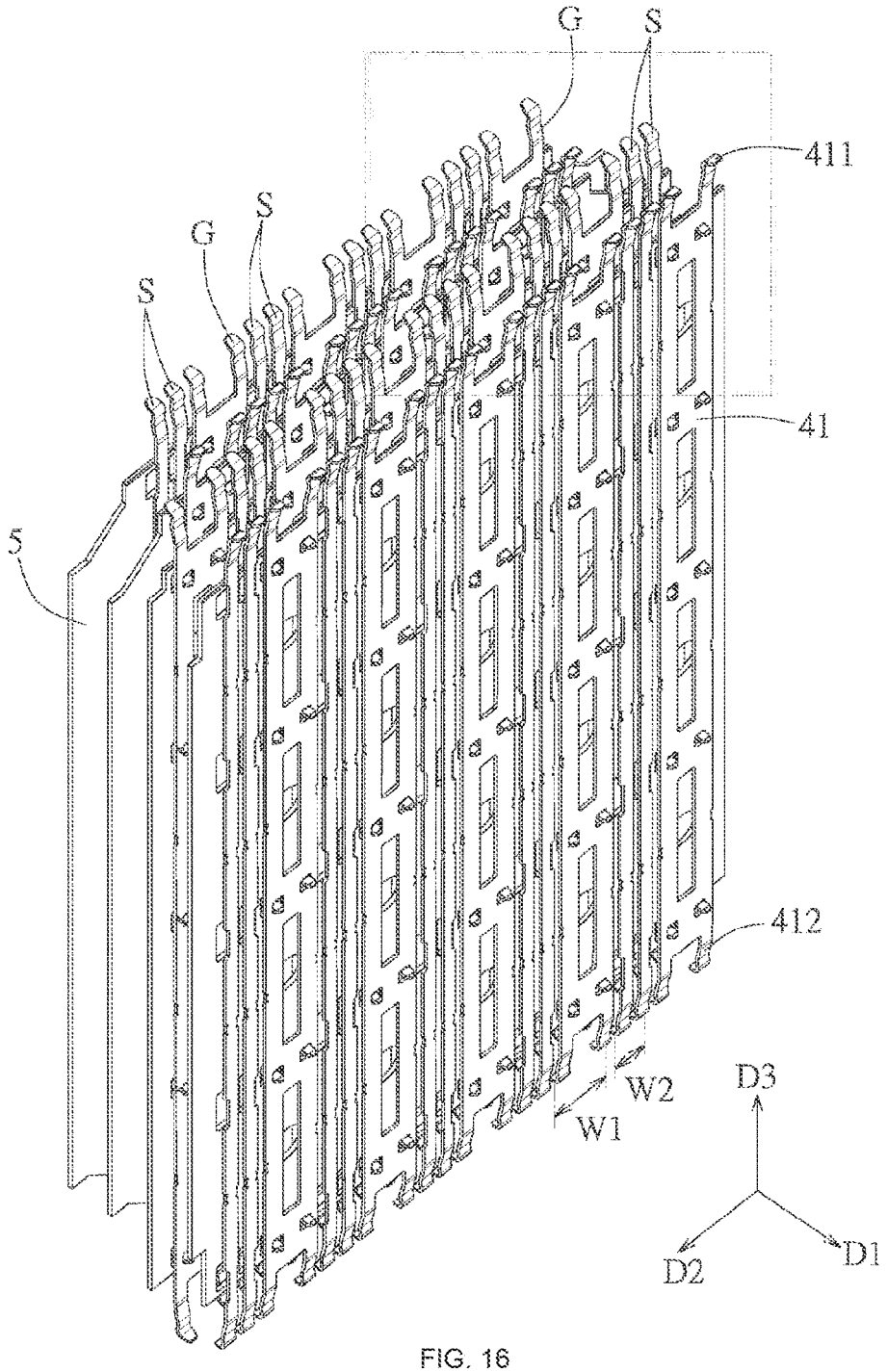
FIG. 16 is a perspective view only illustrating shield plates and conductive terminals in a part of terminal modules in order to illustrate an arrangement relationship between the shield plates and the conductive terminals and an arrangement relationship between the conductive terminals.
Figure 17:
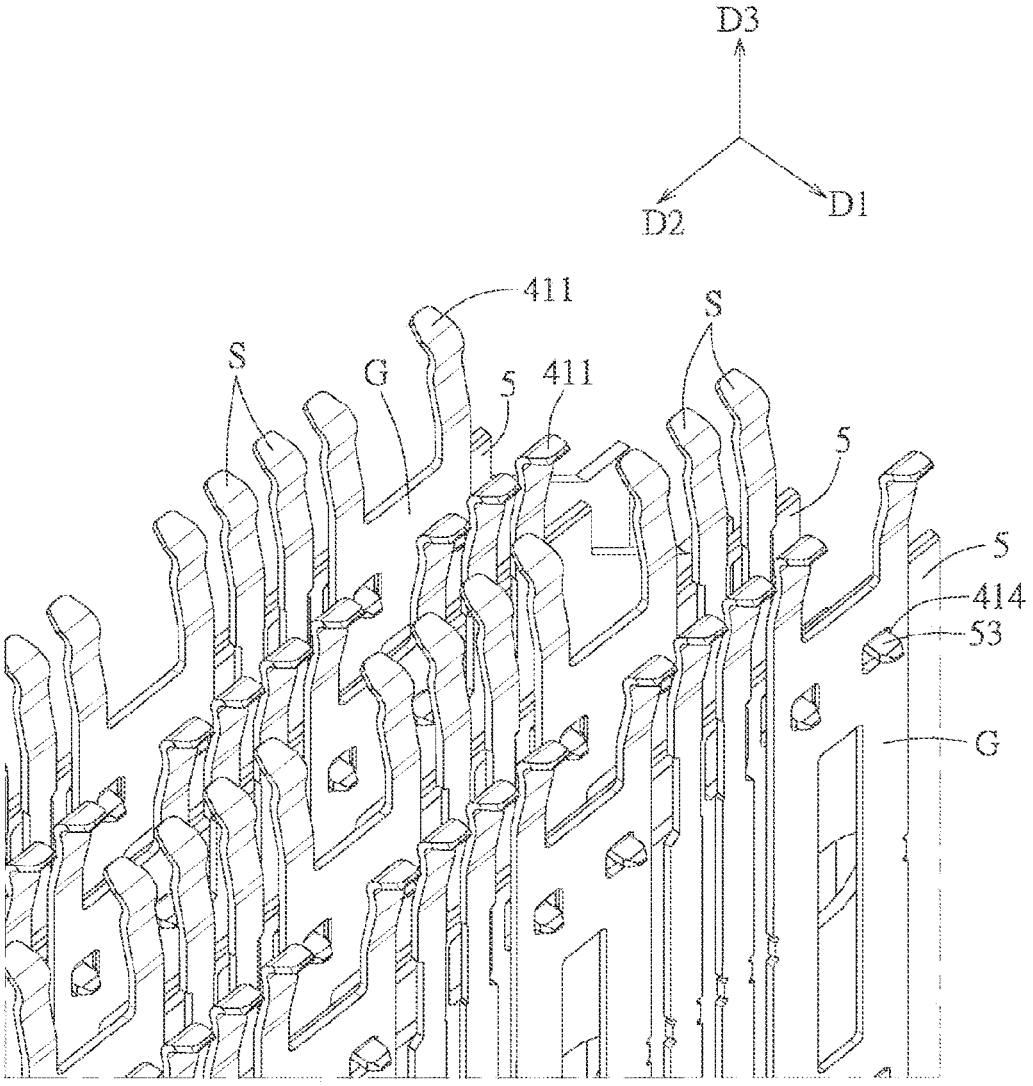
FIG. 17 is a partially enlarged view of FIG. 16.

Referring to FIG. 14 and FIG. 15, another type terminal module 2 in this embodiment is illustrated, for sake of convenient description, the terminal module 2 illustrated in the foregoing FIGS. 8-13 is defined as a group of first type terminal modules 2A, and the terminal module 2 illustrated FIG. 14 and FIG. 15 is defined as a group of second type terminal modules 2B, there are at least two groups of the terminal modules 2 having the same configurations but provided in different directions in the plurality of terminal modules 2. The difference between the second type terminal module 2B and the first type terminal module 2A only lies in the number of the ground terminals G and the number of the signal terminal pairs S, the first type terminal module 2A has four ground terminals G and four signal terminal pairs S, but the second type terminal module 2B has five ground terminals G and five signal terminal pairs S.

Referring to FIG. 1, FIG. 2, FIG. 16 and FIG. 17, in the embodiment, the first contact portion 411 and the second contact portion 412 of each conductive terminal 41 are elastic contact portions and are respectively positioned at the first mating port 6 and the second mating port 6', and the tip of the first contact portion 411 and the tip of the second contact portion 412 of each terminal module 2 face opposite directions in the first direction D1, and the tips of the first contact portions 411 of the conductive terminals 41 of the adjacent terminal modules 2 face opposite directions in the first direction D1 and the tips of the second contact portions 412 of the conductive terminals 41 of the adjacent terminal modules 2 face opposite directions in the first direction D1. In the embodiment, the first contact portion 411 and the second contact portion 412 of each ground terminal G each are formed by two elastic arms spaced apart from each other along the second direction D2, and the first contact portion 411 and the second contact portion 412 of each signal terminal of each signal terminal pair S each are formed by one elastic arm. Additionally in combination with FIG. 6, an overall width W1 of each ground terminal G from up to down in the second direction D2 is greater than an overall width W2 between opposite outer sides of each signal terminal pair S from up to down in the second direction D2, and positions of the signal terminal pairs S of the adjacent terminal modules 2 are staggered and thus are not overlapped in the first direction D1, positions of the ground terminals G of the adjacent terminal modules 2 in the first direction D1 are staggered but are partially overlapped at edge portions, that is, each signal terminal pair S of one of the adjacent terminal modules 2 is positioned within a range covered by the width of the corresponding ground terminal G of the other of the adjacent terminal modules 2 in the first direction D1. Therefore, the overall width W2 of the signal terminal is smaller than the overall width W1 of the ground terminal G in each terminal module 2 and is within a range covered by the width W1 of the corresponding ground terminal G of the adjacent terminal module 2, so that virtual shield between the signal terminal pairs S in the same terminal module 2 and virtual shield between the signal terminal pairs S between the adjacent terminal modules 2 can be strengthened, and crosstalk can be reduced. In addition, most of the signal terminal pairs S each are surrounded by the ground terminals G of the same terminal module 2 and the ground terminal G of the adjacent terminal module 2, and the virtual shield can also be enhanced to reduce crosstalk.

Referring to FIG. 1, FIG. 2 and FIG. 18 to FIG. 24, each insulating spacer 1 has the following common features: a main body 11 which has a substantially rectangular plate shape and a spacing strip 12 which is formed at one side of the main body 11 in the third direction D3 to correspondingly form a protruding strip 61 in the first mating port 6 (the second mating port 6') and the other side of the main body 11 in the third direction D3 is not formed with a spacing strip 12 so as to correspondingly form a slot 62 in the first mating port 6 (the second mating port 6'), positions of the spacing strips 12 of the adjacent insulating spacers 1 are staggered up and down in the third direction D3, that is, the spacing strip 12 of one of the two adjacent insulating spacers 1 is positioned at an upper side, and the spacing strip 12 of the other of the two adjacent insulating spacers 1 is positioned at a lower side, so that the protruding strips 61 are alternately arranged with the slots 62 in the first mating port 6 (the second mating port 6'). The tips of the first contact portions 411 of the conductive terminals 41 of each terminal module 2 face the spacing strip 12 of an adjacent insulating spacer 1, the tips of the second contact portions 412 of the conductive terminals 41 of each terminal module 2 face the spacing strip 12 of an adjacent insulating spacer 1, and each spacing strip 12 has a plurality of receiving grooves 121 correspondingly receiving the plurality of first receiving portions 411 or the plurality of second contact portions 412. The plurality of first contact portions 411 and the plurality of second contact portions 412 are received to the corresponding receiving grooves 121 respectively. Each insulating spacer 1 is formed with limiting blocks 13*a*, 13*b*, 13*c*, 13*d* protruding from the main body 11 in the first direction D1 respectively at four corners of the main body 11, and four corners of each terminal plate 4 interposed between the two insulating spacers 1 each are formed with a notch 422, and each notch 422 provides a space to allow the corresponding limiting block 13*a*, 13*b*, 13*c*, 13*d* of the four corners of each insulating spacer 1 of the two adjacent insulating spacers 1 to be placed in, that is, each limiting block 13*a*, 13*b*, 13*c*, 13*d* of one of the two adjacent insulating spacers 1 and the corresponding limiting block 13*a*, 13*b*, 13*c*, 13*d* of the other of the two adjacent insulating spacers 1 can together extend into the notch 422 of the terminal plate 4. Each terminal module 2 is interposed between two adjacent insulating spacers 1 in the first direction D1, and each terminal module 2 is limited by the limiting blocks 13*a*, 13*b*, 13*c*, 13*d* at the corners of two adjacent insulating spacers 1 in the third direction D3 and the second direction D2.

Figure 5A:
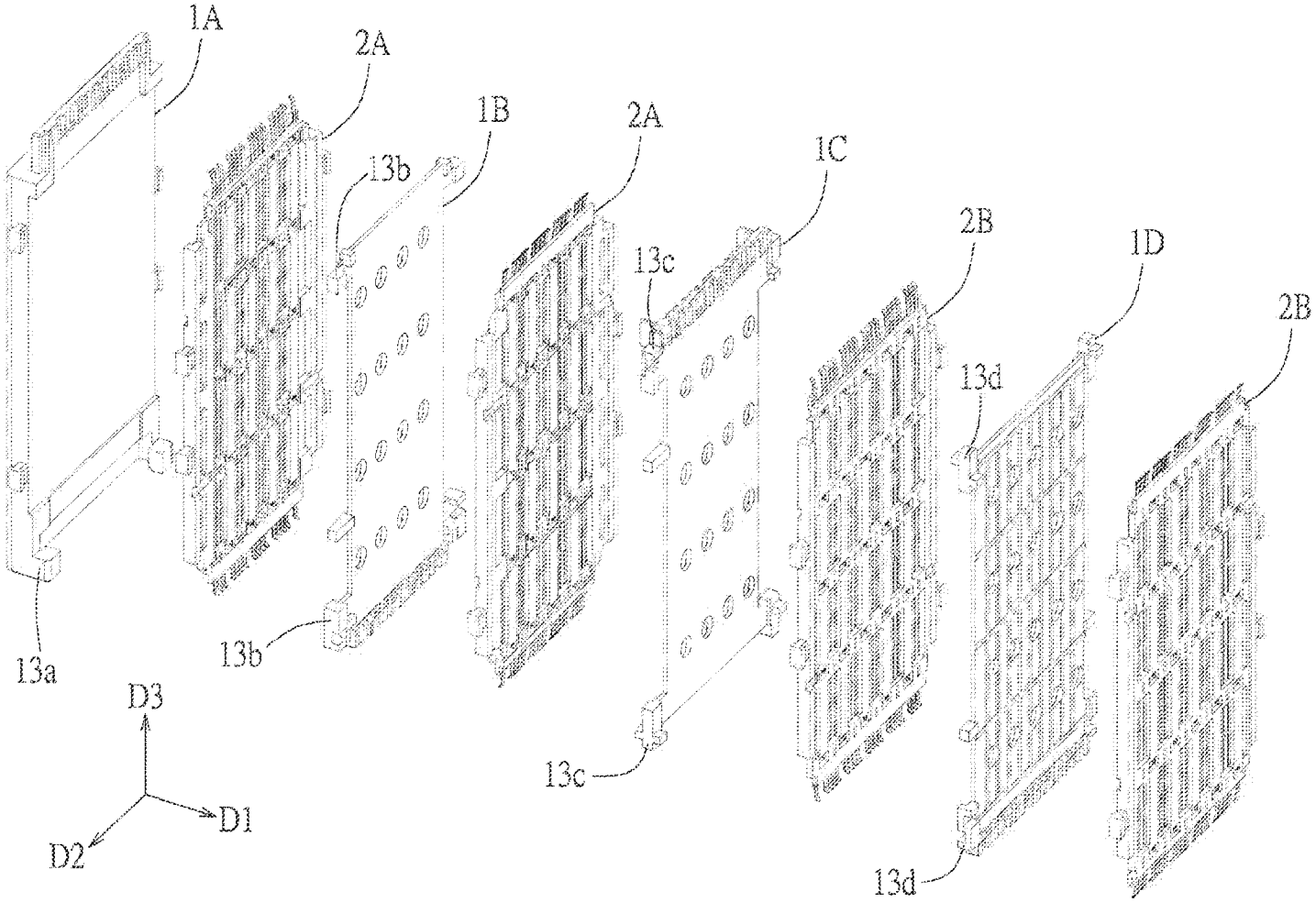
FIG. 5*a*, FIG. 5*b* and FIG. 5*c* are fully exploded views corresponding to FIG. 4, in order to clearly illustrate the contents of the figures, they are arranged in three pages.
Figure 5B:
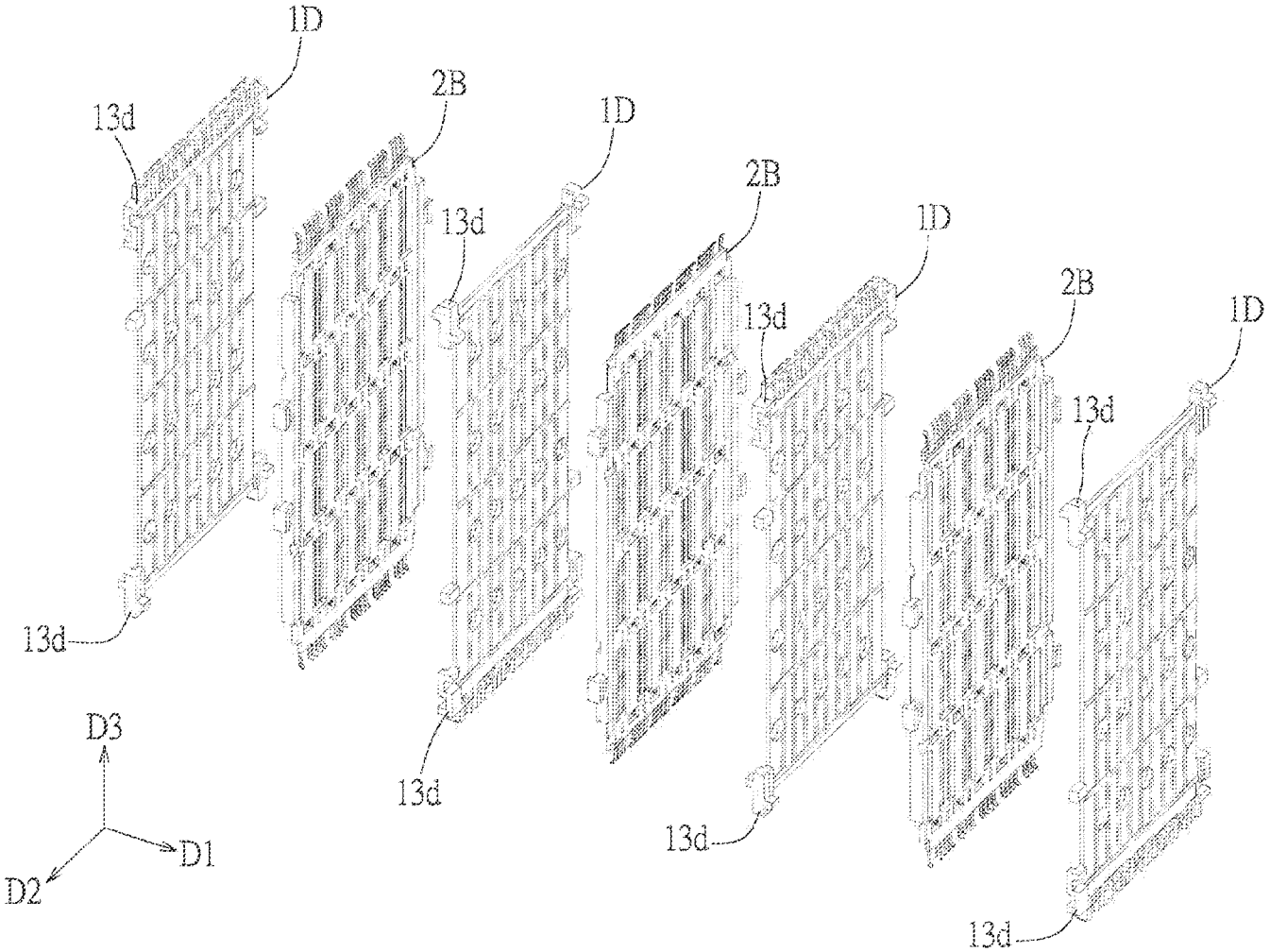
Figure 5C:
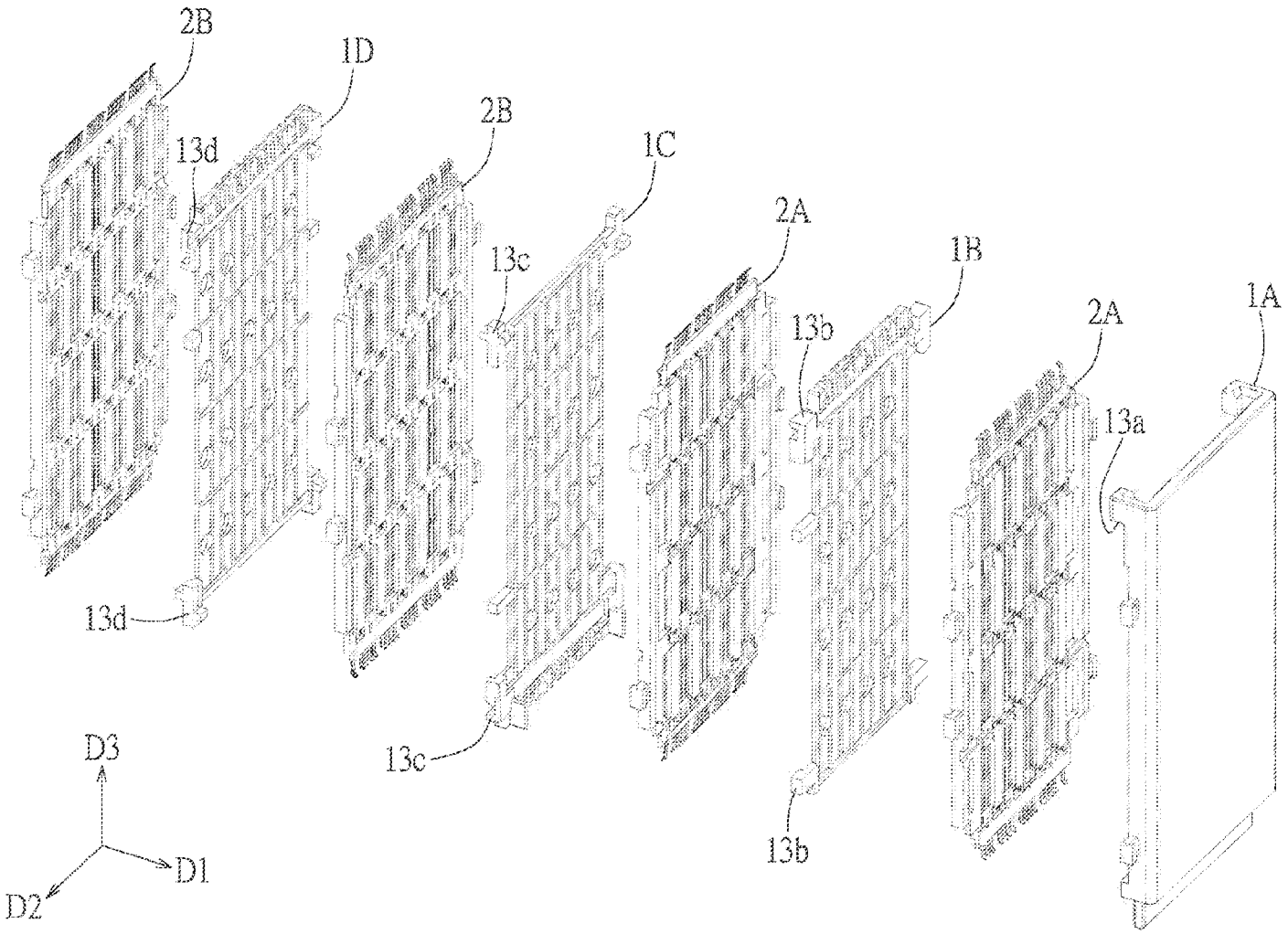
Figure 18:
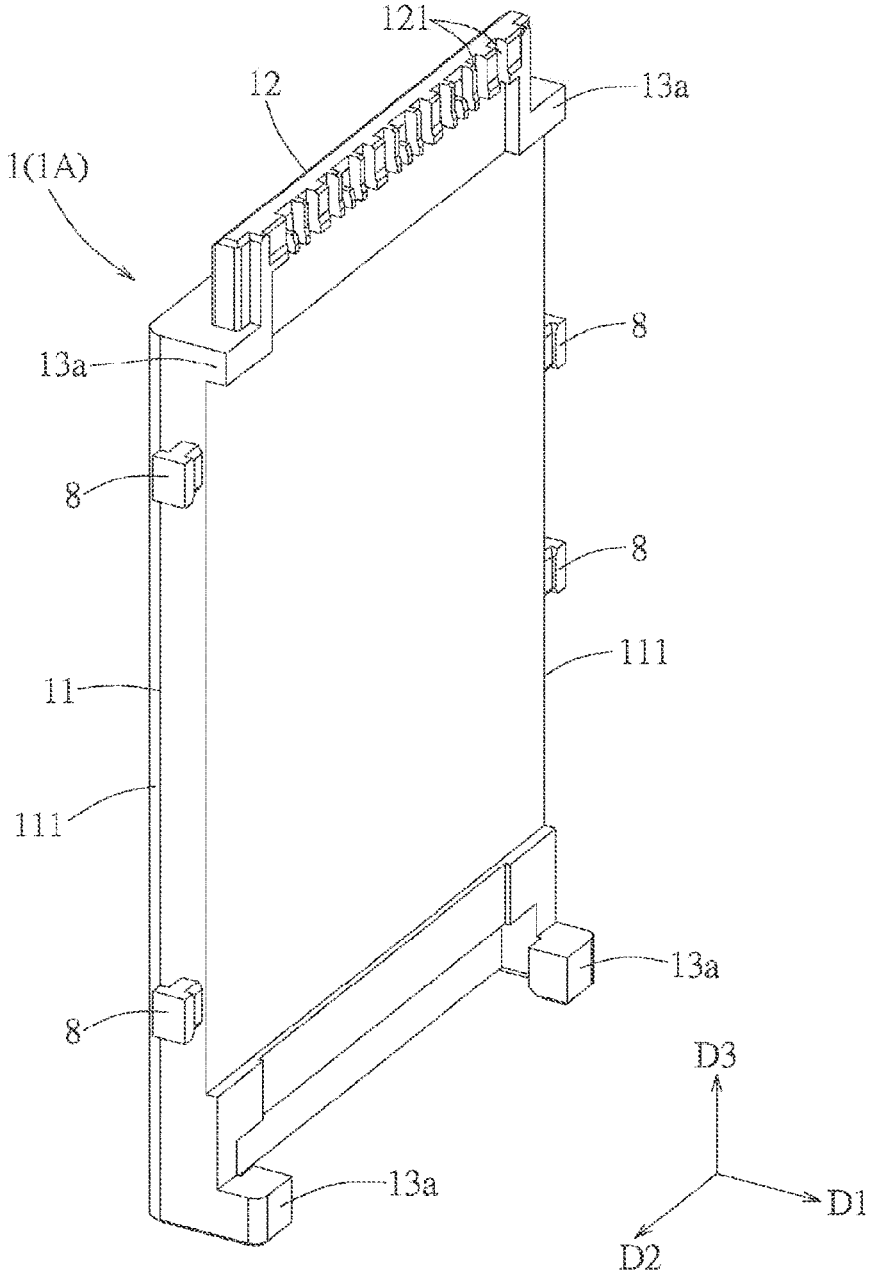
FIG. 18 is a perspective view of a first type insulating spacer of the intermediate adapter connector.
Figure 19:
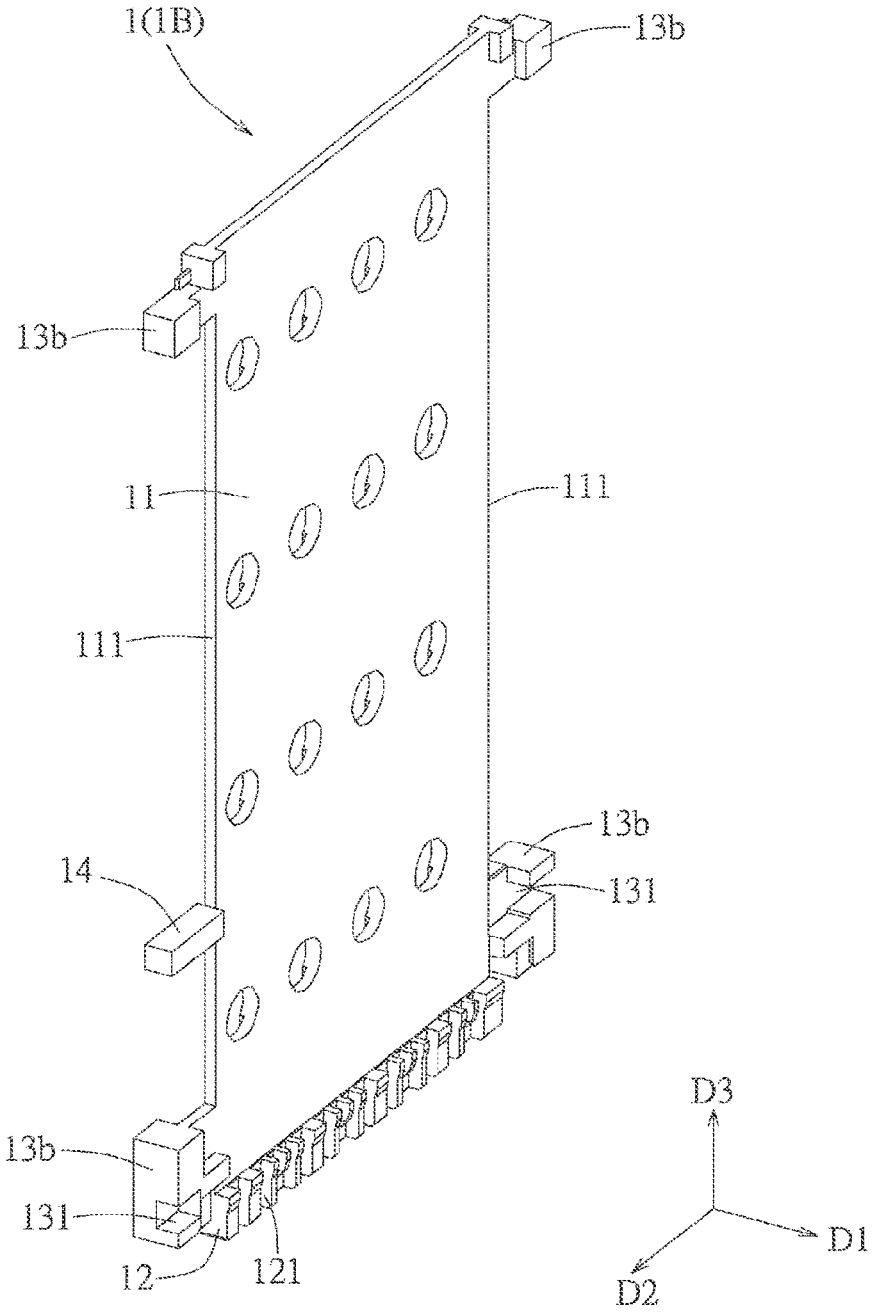
FIG. 19 is a perspective view of a second type insulating spacer of the intermediate adapter connector.
Figure 20:
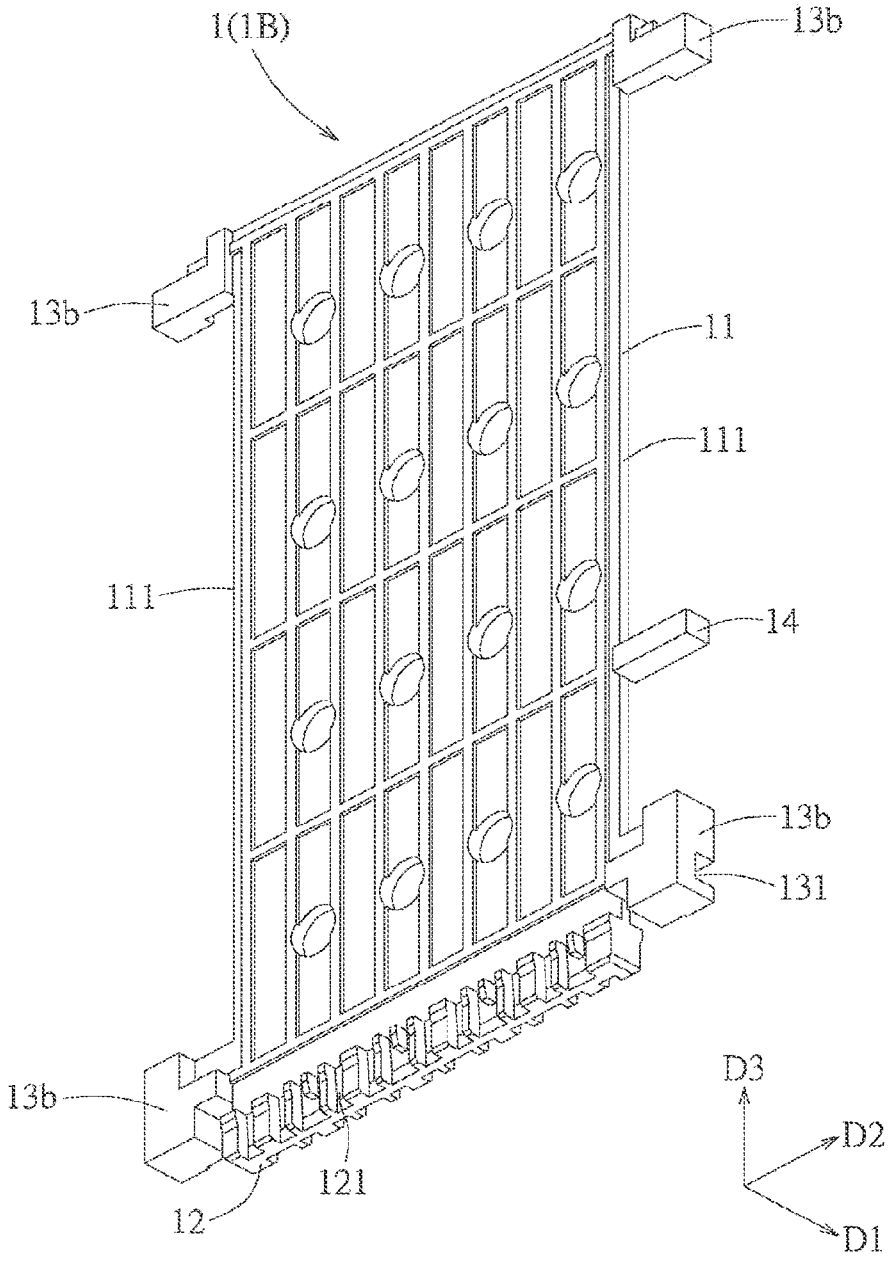
FIG. 20 is a view of FIG. 19 from another angle.
Figure 21:
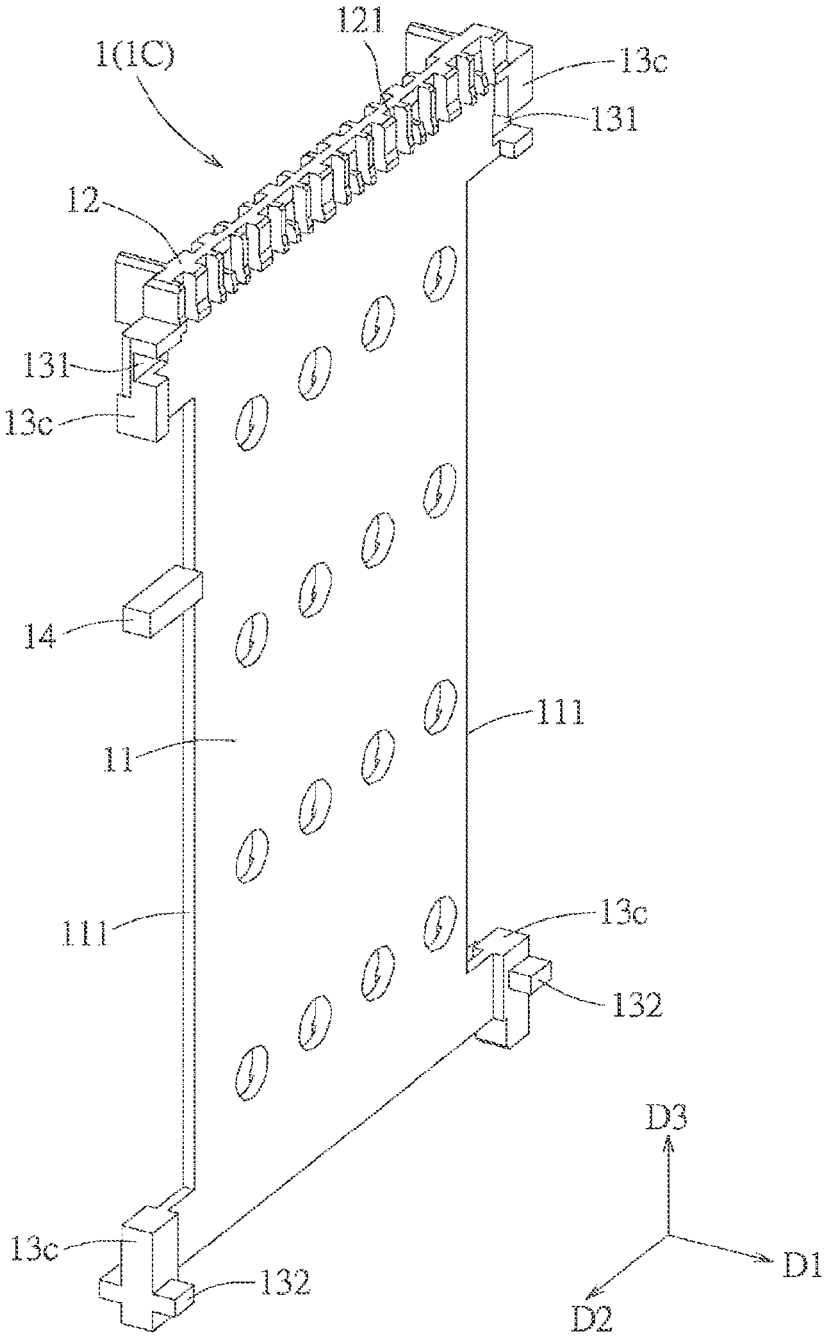
FIG. 21 is perspective view of a third type insulating spacer of the intermediate adapter connector.
Figure 22:
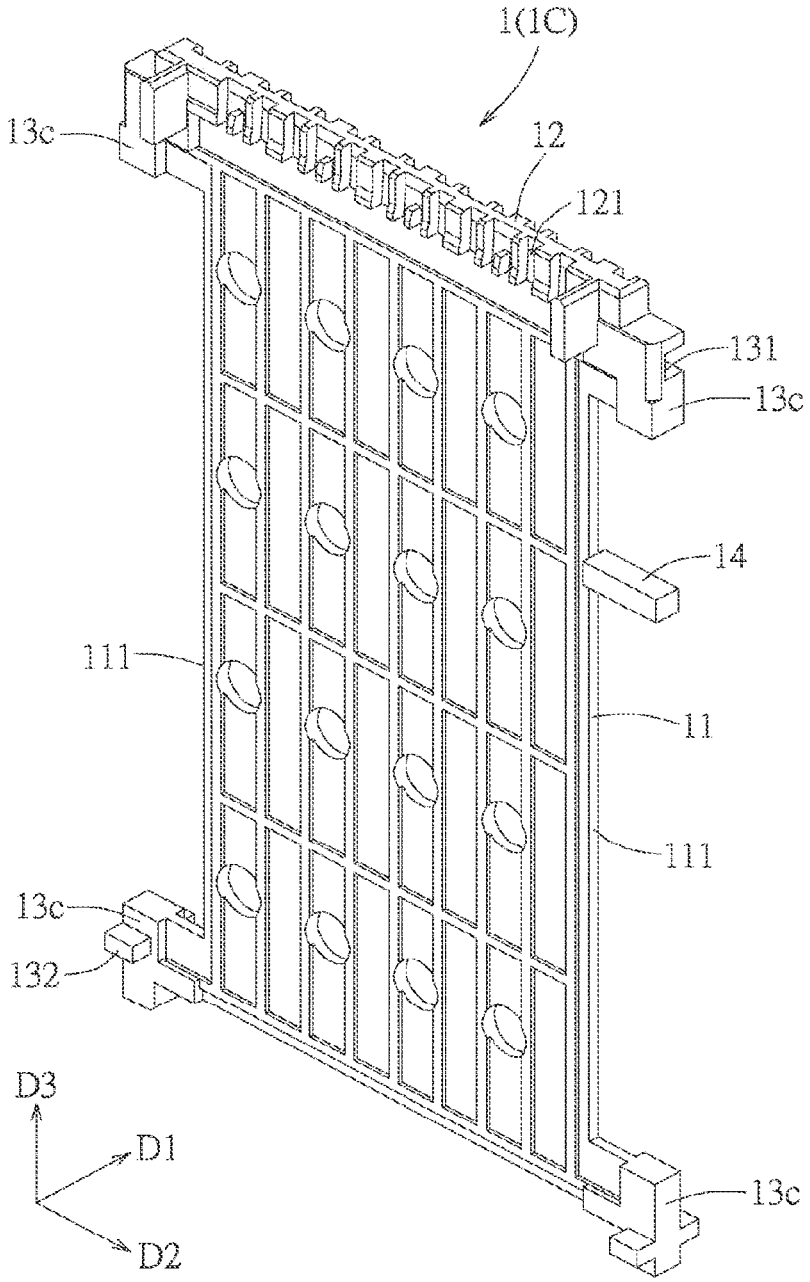
FIG. 22 is a view of FIG. 21 from another angle.
Figure 23:
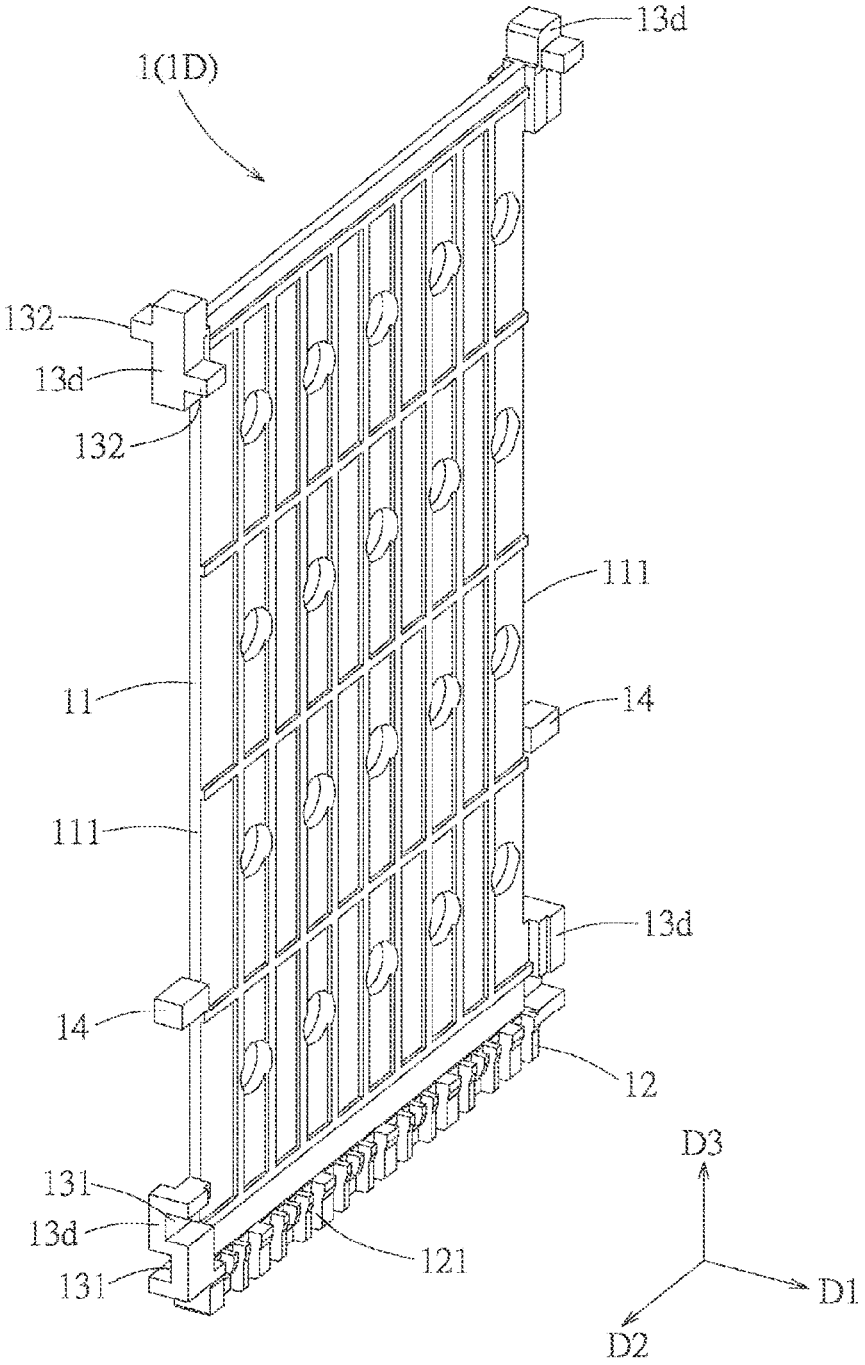
FIG. 23 is the intermediate adapter connector of a fourth type insulating spacer of perspective view.
Figure 24:
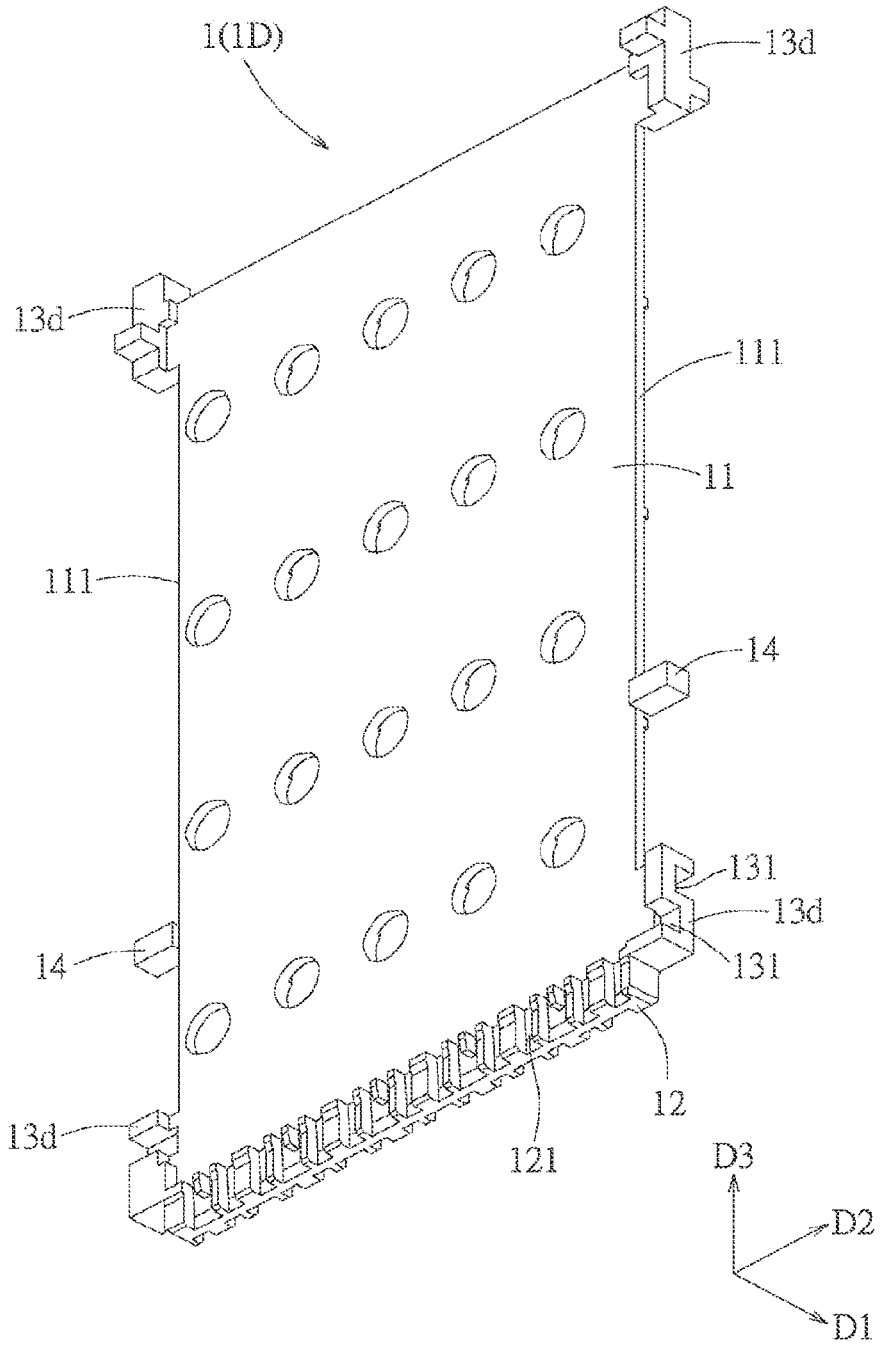
FIG. 24 is a view of FIG. 23 from another angle.

Referring to FIG. 3 to FIG. 5*c* and FIG. 18 to FIG. 24, in the embodiment, each insulating spacer 1 has different configurations in addition to the above-mentioned common features, and for sake of convenient description, the insulating spacer 1 shown in FIG. 18 is defined as a group of first type insulating spacers 1A, and the insulating spacer 1 shown in FIG. 19 and FIG. 20 is defined as a group of second type insulating spacers 1B, the insulating spacer 1 shown in FIG. 21 and FIG. 22 is defined as a group of third type insulating spacers 1C, and the insulating spacer 1 shown in FIG. 23 and FIG. 24 is defined as a group of fourth type insulating spacers 1D, there are at least two groups having the same configurations but provided at different directions in the plurality of insulating spacers 1. There are two first type insulating spacers 1A for being respectively provided at outermost sides; there are two second type insulating spacers 1B for allowing each second type insulating spacer 1B to be provided between two adjacent first type terminal modules 2A; there are two third type insulation spacers 1C for allowing each third type insulation spacer 1C to be provided between the first type terminal module 2A and the second type terminal module 2B which are adjacent; there are six fourth type insulating spacers 1D for allowing each fourth type insulating spacer 1D to be provided between two adjacent second type terminal modules 2B. As shown in FIG. 5*a* to FIG. 5*c*, the two first type insulating spacers 1A have the same configurations, but are provided at different directions, specifically, one of the two first type insulating spacers 1A is rotated about a rotational axis parallel to the second direction D2 by 180 degrees relative to the other of the two first type insulating spacers 1A, and thus the two first type insulating spacers 1A respectively at the two outermost sides are provided at different directions. There are four first type terminal modules 2A, and every two first type terminal modules 2A of the four first type terminal modules 2A are set as one group and provided adjacent to one of the two first type insulating spacers 1A, and the two first type insulating spacer 1A of the same group are provided at different directions by rotating one of the two first type insulating spacer 1A of the same group about a rotational axis parallel to the first direction D1 by 180 degrees relative to the other of the two first type insulating spacer 1A of the same group, one second type insulating spacer 1B is provided between the two first type terminal modules 2A of the same group, and the two second type insulating spacers 1B which each are provided between the two first type terminal modules 2A of different group are provided at different directions by rotating one of the two second type insulating spacers 1B about a rotational axis parallel to the second direction D2 by 180 degrees relative to the other of the two second type insulating spacers 1B. The terminal modules 2 positioned between the two groups of the first type terminal modules 2A all are the second type terminal modules 2B, and there are seven second type terminal modules 2B, two adjacent second type terminal modules 2B are provided at different directions by rotating one of the two adjacent second type terminal modules 2B about a rotational axis parallel to the first direction D1 by 180 degrees relative the other of the two adjacent second type terminal modules 2B. The two third type insulating spacers 1C are provided at different directions by rotating one of the two third type insulating spacers 1C about a rotational axis parallel to the second direction D2 by 180 degrees relative to the other one of the two third type insulating spacers 1C. The two adjacent fourth type insulating spacers 1D are provided at different directions by rotating one of the two adjacent fourth type insulating spacers 1D about a rotational axis parallel to the first direction D1 by 180 degrees relative to the other of the two adjacent fourth type insulating spacers 1D. That is to say, by that the insulating spacers 1 having the same configurations and the terminal blocks 2 having the same configurations are provided at different directions, arranged and combined, a main structure of the intermediate adapter connector 300 can be formed, and the overall combine structure is simplified in the structure in which the number of the terminals arranged varies, which is not only convenient to manufacture to reduce manufacturing cost, but also has more flexible expansion performance.

Referring to FIG. 5*a* to FIG. 5*c*, at least one positioning block 14 protrudes from the left and right sides of the main body 11 of each of the second to fourth type insulating spacers 1B, 1C, and 1D in the embodiment, and four corners of the main body 11 of each of the second to fourth type insulating spacers 1B, 1C, and 1D each are formed with a limiting block 13*b*, 13*c*, 13*d*. Also referring to the fourth type insulating spacer 1D shown in FIG. 23 and FIG. 24, in the fourth type insulating spacer 1D as shown, the two limiting blocks 13*d* respectively positioned above left and right edges of the main body 11 are respectively provided with protruding blocks 132 which are staggered in position and direction, and the two limiting blocks 13*d* respectively positioned below left and right edges of the main body 11 are respectively provided with recessed grooves 131 which are staggered in position and direction. In combination, one of the two adjacent fourth type insulating spacers 1D is provided at a different direction by rotating the one of the two adjacent fourth type insulating spacers 1D about a rotational axis parallel to the front-rear direction by 180 degrees relative to the other of the two adjacent fourth type insulating spacers 1D, therefore, the two limiting blocks 13*d* which correspond to each other in position between the two adjacent fourth insulating spacers 1D in the front-rear direction can form the recessed groove 131 and the protruding block 132 which are complementarily cooperated. Also referring to the third type insulating spacer 1C shown in FIG. 21 and FIG. 22, the two third type insulating spacers 1C are respectively positioned at opposites outer sides of the fourth type insulating spacers 1D in the first direction D1, the limiting blocks 13*c* of the four corners of the third type insulating spacer 1C as shown and the corresponding limiting blocks 13*d* of an adjacent fourth type insulating spacer 1D have the protruding block 132 and the recessed groove 131 which are complementarily cooperated, it can be understood that the other third type insulating spacer 1C has the same configuration and is only rotated upside down to cooperate with another adjacent fourth type insulating spacer 1D. Also referring to the second type insulating spacer 1B shown in FIG. 19 and FIG. 20, the two second type insulating spacers 1B are respectively positioned at opposite outer sides of the third type insulating spacers 1C in the first direction D1, for example, the two limiting blocks 13*b* respectively positioned at left and right sides of a lower portion of the second type insulating spacer 1B as shown respectively have recessed grooves 131 which cooperate with the corresponding limiting blocks 13*c* of an adjacent third type insulating spacer 1C, it can be understood that the other second type insulating spacer 1B has the same configuration and is only rotated upside down to cooperate with another adjacent third type insulating spacer 1C. Referring to FIG. 18, the four corners of the main body 11 of the two insulating spacers 1A respectively positioned at the outermost sides in the first direction D1 each are also formed with a limiting block 13*a*, as shown in FIG. 18, the two limiting blocks 13*a* of the first type insulating spacer 1A positioned above the main body 11 correspond to positions of the limiting blocks 13*b* of an adjacent second type insulating spacers 1B in the third direction D3, the two limiting blocks 13*a* below the main body 11 are positioned below the limiting blocks 13*b* of the adjacent second type insulating spacer 1B in the third direction D3. It can be understood that the other first type insulating spacer 1A has the same configuration and is only rotated upside down to cooperate with another adjacent second type insulating spacer 1B. In this way, by the combination of the concave-convex complementary structures of the plurality of limiting blocks 13*a*, 13*b*, 13*c*, and 13*d* as described above, the first to fourth type insulating spacers 1A, 1B, 1C, and 1D can attain positional limiting function in both the second direction D2 and the third direction D3. In the embodiment, the terminal plate 4 is formed with one notch 422 at each of the four corners of the plate body 42, when the insulating spacers 1A, 1B, 1C, 1D are stacked and the terminal modules 2 are interposed between them, the notches 422 respectively provide spaces in which the limiting blocks 13*a*, 13*b* 13*c* and 13*d* of the adjacent insulating spacers 1 can be respectively placed, and shapes of the notches 422 are cooperated with the corresponding limiting blocks 13*a*, 13*b*, 13*c*, 13*d*, by stacking the plurality of terminal modules 2 with the plurality of insulating spacers 1, each terminal module 2 is interposed between adjacent insulating spacers 1, and the limiting blocks 13*a*, 13*b*, 13*c*, 13*d* are respectively placed in the corresponding notches 422, each terminal module 2 can be limited in position in the first direction D1, the second direction D2 and the third direction D3 by the adjacent insulating spacers 1 and the limiting blocks 13*a*, 13*b*, 13*c*, 13*d* at the corners of the adjacent insulating spacers 1.

In addition, in the embodiment, the edge strips 426 of the plate body 42 of the terminal plate 4 of each terminal module 2 are formed with inserting grooves 421 respectively corresponding to the positioning blocks 14, the positioning block 14 on each insulating spacer 1 is accommodated in a space formed by the inserting grooves 421 of the adjacent terminal plates 4, therefore, the relative displacement of the insulating spacer 1 and the terminal module 2 which are stacked is limited in the third direction D3 and the first direction D1. In addition, in the embodiment, a width between plate edges 111 of the main body 11 of each of the insulating spacers 1B, 1C, 1D in the left-right direction is smaller than a width between the edge strips 426 of the plate body 42 of the terminal block 4 of the terminal module 2, and two sides of the edge strip 426 in the front-rear direction respectively protrude from plate surfaces of the plate piece 420, therefore, when the plurality of terminal modules 2 and the plurality of insulating spacers 1 are stacked, the plate edges 111 of the main body 11 of each of the insulating spacers 1B, 1C, 1D in the left-right direction are limited between the edge strips 426 of the plate bodies 42 of the adjacent terminal plates 4 in the left-right direction, the edge strips 426 of the plate bodies 42 of the terminal plates 4 positioned on the same one of the left and right sides are arranged close to each other.

In the embodiment, both sides of the outermost two (namely, the first type insulating spacers 1A) of the plurality of insulating spacers 1 along the second direction D2 are formed with a plurality of clipping blocks 8, and both sides of each terminal plate 4 along the second direction D2 are formed with a plurality of clipping blocks 8, the clipping blocks 8 correspondingly protrude from two side faces 7, and in the embodiment, positions of the clipping blocks 8 on the same side of each terminal plate 4 are staggered from positions of the clipping blocks 8 of an adjacent first type insulating spacer 1A or positions of the clipping blocks 8 of an adjacent terminal plate 4 in the up-down direction, therefore, when the plurality of terminal modules 2 and the plurality of insulating spacers 1 are stacked, the adjacent clipping blocks 8 do not interfere with each other. The plurality of connecting plates 3 each have a plurality of clipping holes 31 respectively corresponding to the clipping blocks 8 and are respectively provided at two sides of the plurality of insulating spacers 1 and the plurality of terminal modules 2 along the second direction D2 after the plurality of insulating spacers 1 and the plurality of terminal modules 2 are stacked, so as to fix a combination of the plurality of insulating spacers 1 and the plurality of terminal modules 2. Each clipping block 8 is generally T-shaped, each clipping hole 31 is wide on top and narrow on bottom, when the connecting plate 3 is combined with the clipping blocks 8, a wide portion of the clipping hole 31 sheathes the clipping block 8 so that the clipping block 8 passes through the clipping hole 31, then the connecting plate 3 is moved upwardly so that the clipping block 8 enters into a narrow portion of the clipping hole 31 to be clipped, thus the assembling can be completed.

In conclusion, in the intermediate adapter connector 300, by that a plurality of insulating spacers 1 and a plurality of terminal modules 2 are alternately stacked to form a main structure, and the shielding plate 5 of each terminal module 2 can cover a very large part of the plurality of conductive terminals 41 (including a portion of the first contact portion 411 and a portion of the second contact portion 412), and thus can provide comprehensive shielding between the conductive terminals 41 of the adjacent terminal modules 2, which can shield the signal interference more effectively. In addition, there are insulating spacers 1 having the same configurations but provided at different directions in the plurality of insulating spacers 1, and there are terminal modules 2 having the same configurations but provided at different directions in the plurality of terminal module 2, and the overall combine structure is simplified in the structure in which the number of terminals arranged varies, which is not only convenient to manufacture to reduce manufacturing cost, but also has more flexible expansion performance. Moreover, the first mating port 6 and second mating port 6' of the intermediate adapter connector 300 have the same configurations, and are capable of connecting the first connector 100 and the second connector 200 which have the same configurations.

The above contents are only the embodiments of the present disclosure, which does not limit the implementing scope of the present disclosure, and any simple equivalent changes and modifications made according to the claims and specifications of the present disclosure are still covered by the scope of the present disclosure.

What is claimed is:

1. An intermediate adapter connector adapted to electrically connect a first connector and a second connector, the intermediate adapter connector comprising:
- a first mating port configured to mate with the first connector;
- a second mating port configured to mate with the second connector;
- a plurality of insulating spacers; and
- a plurality of terminal modules alternately arranged and stacked with the plurality of insulating spacers in a first direction, such that each terminal module being positioned between two adjacent insulating spacers; each terminal module comprising a terminal plate and a shield plate which are stacked in the first direction, the terminal plate having a plurality of conductive terminals arranged in a second direction, each conductive terminal having a first contact portion positioned at the first mating port and a second contact portion positioned at the second mating port.

2. The intermediate adapter connector of claim 1, wherein the plurality of insulating spacers and the plurality of terminal modules together form the first mating port and the second mating port at opposite sides in a third direction perpendicular to the first direction and the second direction, and the first mating port and the second mating port each have a plurality of protruding strips extending in the second direction and a plurality of slots recessed inwardly relative to the plurality of protruding strips, and the plurality of protruding strips and the plurality of slots are alternately arranged in the first direction.

3. The intermediate adapter connector of claim 2, wherein the first contact portion and the second contact portion of each conductive terminal are elastic contact portions and are respectively positioned at the first mating port and the second mating port, and a tip of the first contact portion and a tip of the second contact portion of each terminal module face opposite directions in the first direction, and the tips of the first contact portions of the conductive terminals of the adjacent terminal modules face the opposite directions in the first direction and the tips of the second contact portions of the conductive terminals of the adjacent terminal modules face the opposite direction in the first direction.

4. The intermediate adapter connector of claim 3, wherein overall arrangement and shape of the protruding strips and the slots of the first mating port is the same as the second mating port but is opposite in position in the first direction.

5. The intermediate adapter connector of claim 3, wherein one side of each insulating spacer in the third direction is formed with a spacing strip correspondingly forming one protruding strip and the other side of each insulating spacer in the third direction is not formed with a spacing strip to correspondingly form the slot, each spacing strip has a plurality of receiving grooves, the tips of the first contact portions of the conductive terminals of each terminal module face the spacing strip of an adjacent insulating spacer and are received in the receiving grooves correspondingly, the tips of the second contact portions of the conductive terminals of each terminal module face the spacing strip of an adjacent insulating spacer and are received in the receiving grooves correspondingly.

6. The intermediate adapter connector of claim 5, wherein there are at least two groups of the insulating spacers having the same configurations but provided at different directions in the plurality of insulating spacers, there are at least two groups of the terminal modules having the same configurations but provided at different directions.

7. The intermediate adapter connector of claim 1, wherein the plurality of conductive terminals of each terminal module are composed of a plurality of ground terminals and a plurality of signal terminal pairs, and the plurality of ground terminals and the plurality of signal terminal pairs are alternately arranged in the second direction, the shield plate of each terminal module is mechanically and electrically connected with the plurality of ground terminals.

8. The intermediate adapter connector of claim 7, Wherein the terminal plate of each terminal module further has a plate body which is insulative, and the plurality of conductive terminals are embedded in the plate body, the shield plate is engaged with a plate surface of the plate body.

9. The intermediate adapter connector of claim 8, wherein a width of each ground terminal in the second direction is greater than a width between opposite outer sides of each signal terminal pair in the second direction, and positions of the signal terminal pairs of the adjacent terminal modules are staggered and are not overlapped in the first direction, each signal terminal pair of one of two adjacent terminal modules is positioned within a range covered by the width of the corresponding ground terminal of the other of the adjacent terminal modules in the first direction.

10. The intermediate adapter connector of claim 8, wherein the plurality of insulating spacers each are formed with limiting blocks respectively at four corners of each insulating spacer, four corners of each terminal plate interposed between the insulating spacers each are formed with a notch providing a space to allow the corresponding limiting block of each insulating spacer to be placed in.

11. The intermediate adapter connector of claim 10, wherein the two limiting blocks which correspond to each other in position in some adjacent insulating spacers are formed with a recessed groove and a protruding block which are complementarily cooperated.

12. The intermediate adapter connector of claim 11, wherein the plate body of each terminal plate has a plate piece and two edge strips, the two edge strips are positioned at two opposite edges of the plate piece along the second direction, a width between two opposite plate edges of a main body of each insulating spacer along the second direction is smaller than a width between the two edge strips of the plate body of each terminal plate, when the plurality of terminal modules and the plurality of insulating spacers are stacked, the two plate edges of the main body of the insulating spacer are limited between the edge strips of the plate bodies of the adjacent terminal plates in the second direction.

13. The intermediate adapter connector of claim 12, wherein the main bodies of some of the plurality of insulating spacers are formed with positioning blocks protruding along the second direction, the edge strips of the plate body of each terminal plate are formed with inserting grooves corresponding to the positioning blocks, when the plurality of terminal modules and the plurality of insulating spacers are stacked, the positioning block of the insulating spacers is accommodated in a space formed by the inserting grooves of the adjacent terminal plates.

14. The intermediate adapter connector of claim 1, wherein both sides of at least outermost two of the plurality of insulating spacers along the second direction are formed with a plurality of clipping blocks, and both sides of each terminal plate along the second direction are formed with a plurality of clipping blocks, and the clipping blocks of each terminal plate and the clipping blocks of an adjacent insulating spacer and the clipping blocks of another adjacent terminal plate are staggered along the third direction, the intermediate adapter connector further comprises a plurality of connecting plates, the plurality of connecting plate each have a plurality of clipping holes respectively corresponding to the clipping blocks and are respectively provided at two sides of the plurality of insulating spacers and the plurality of terminal modules along the second direction after the plurality of insulating spacers and the plurality of terminal modules are stacked, so as to fix a combination of the plurality of insulating spacers and the plurality of terminal modules.

15. An electrical connector assembly comprising:

a first connector configured to mount on a first circuit board;

a second connector configured to mount on a second circuit board; and an intermediate adapter connector configured to mate with the first connector and the second connector to electrically connect the first connector and the second connector, the intermediate adapter connector comprising:

a first mating port configured to mate with the first connector;

a second mating port configured to mate with the second connector;

a plurality of insulating spacers; and a plurality of terminal modules alternately arranged and stacked with the plurality of insulating spacers in a first direction, such that each terminal module being positioned between two adjacent insulating spacers; each terminal module comprising a terminal plate and a shield plate which are stacked in the first direction, the terminal plate having a plurality of conductive terminals arranged in a second direction, each conductive terminal having a first contact portion positioned at the first mating port and a second contact portion positioned at the second mating port;

the plurality of insulating spacers and the plurality of terminal modules together forming the first mating port and the second mating port at opposite sides in a third direction perpendicular to the first direction and the second direction, the first mating port and the second mating port being configured to mate with the first connector and the second connector respectively.

16. The electrical connector assembly of claim 15, wherein the first connector and the second connector have the same overall configurations and are capable of mating with each other, a configuration of the first mating port corresponds to the second connector, a configuration of the second mating port corresponds to the first connector, so that the first mating port is capable of mating with the first connector and the second mating port is capable of mating with the second connector.

17. The electrical connector assembly of claim 15, wherein the plurality of conductive terminals of each terminal module are composed of a plurality of ground terminals and a plurality of signal terminal pairs, and the plurality of ground terminals and the plurality of signal terminal pairs are alternately arranged in the second direction, the shield plate of each terminal module is mechanically and electrically connected with the plurality of ground terminals.

18. The electrical connector assembly of claim 15, wherein the plurality of insulating spacers each are formed with limiting blocks respectively at four corners of each insulating spacer, four corners of each terminal plate interposed between the insulating spacers each are formed with a notch providing a space to allow the corresponding limiting block of each insulating spacer to be placed in.

19. The electrical connector assembly of claim 15, wherein both sides of at least outermost two of the plurality of insulating spacers along the second direction are formed with a plurality of clipping blocks, and both sides of each terminal plate along the second direction are formed with a plurality of clipping blocks, and the clipping blocks of each terminal plate and the clipping blocks of an adjacent insulating spacer and the clipping blocks of another adjacent terminal plate are staggered along the third direction, the intermediate adapter connector further comprises a plurality of connecting plates, the plurality of connecting plate each have a plurality of clipping holes respectively corresponding to the clipping blocks and are respectively provided at two sides of the plurality of insulating spacers and the plurality of terminal modules along the second direction after the plurality of insulating spacers and the plurality of terminal modules are stacked, so as to fix a combination of the plurality of insulating spacers and the plurality of terminal modules.

20. The electrical connector assembly of claim 15, wherein the first connector and the second connector are mezzanine connectors.

* * * * *